US006740804B2

(12) United States Patent
Shimizu et al.

(10) Patent No.: US 6,740,804 B2
(45) Date of Patent: May 25, 2004

(54) WAVEFORM GENERATING METHOD, PERFORMANCE DATA PROCESSING METHOD, WAVEFORM SELECTION APPARATUS, WAVEFORM DATA RECORDING APPARATUS, AND WAVEFORM DATA RECORDING AND REPRODUCING APPARATUS

(75) Inventors: Masahiro Shimizu, Hamamatsu (JP); Yasuhiro Kawano, Hamamatsu (JP); Hidemichi Kimura, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/067,458

(22) Filed: Feb. 4, 2002

(65) Prior Publication Data

US 2002/0105359 A1 Aug. 8, 2002

(30) Foreign Application Priority Data

Feb. 5, 2001 (JP) ..... 2001-027987
Feb. 5, 2001 (JP) ..... 2001-027988
Feb. 1, 2002 (JP) ..... 2002-025100

(51) Int. Cl.[7] ..... A63H 5/00; G04B 13/00; G10H 7/00

(52) U.S. Cl. ..... 84/609; 84/604; 84/610; 84/616

(58) Field of Search ..... 84/600–612, 615–616, 84/622–626, 634–636

(56) References Cited

U.S. PATENT DOCUMENTS 5,686,682 A * 11/1997 Ohshima et al. ..... 84/603
5,936,180 A * 8/1999 Ando ..... 84/604
6,150,598 A * 11/2000 Suzuki et al. ..... 84/603
6,281,423 B1 * 8/2001 Shimizu et al. ..... 84/622
6,403,871 B2 * 6/2002 Shimizu et al. ..... 84/622
6,452,082 B1 * 9/2002 Suzuki et al. ..... 84/609

FOREIGN PATENT DOCUMENTS

JP 07-325579 12/1995

* cited by examiner

*Primary Examiner*—Marlon T. Fletcher
(74) *Attorney, Agent, or Firm*—Morrison & Foerster LLP

(57) ABSTRACT

A waveform generating method is provided, which is capable of generating expressive musical tones. A plurality of partial waveforms are stored in a partial waveform memory. Property information on respective ones of the partial waveforms stored in the partial waveform memory is stored in a property information memory. The property information is retrieved according to inputted sounding control information in order to read out a partial waveform having property information corresponding to the sounding control information. The readout partial waveform is then processed according to the property information and the sounding control information to generate a waveform corresponding to the sounding control information.

23 Claims, 15 Drawing Sheets

WAVEFORM GENERATING METHOD, PERFORMANCE DATA PROCESSING METHOD, WAVEFORM SELECTION APPARATUS, WAVEFORM DATA RECORDING APPARATUS, AND WAVEFORM DATA RECORDING AND REPRODUCING APPARATUS

BACKGROUND OF THE INVENTION

1. Field of the Invention

This invention relates to a waveform generating method, a performance data processing method, a waveform selection apparatus, a waveform data recording apparatus, and a waveform data recording and reproducing apparatus for use in making performance using recorded musical instrument tones and singing tones.

2. Description of the Related Art

Conventionally, there is known a waveform memory tone generator. The waveform memory tone generator generates musical tones by reading out waveform data stored in a waveform memory according to event data such as note-on and note-off. In reading waveform data from the waveform memory, different waveform data are selected from the waveform memory according to pitch information and touch information contained in note-on events.

On the other hand, an electronic musical instrument called a sampler is also conventionally known. The sampler samples and records waveforms of monotones being performed (for example, a pitch C3 for five seconds) and generates musical tones using the recorded waveform data. In this case, the user sets original keys representing tone pitches of respective ones of the sampled waveform data, for the respective sampled waveform data. A range where the waveform data is to be used, an amount of pitch shift during sounding at a predetermined pitch, and the like are determined according to the original keys. To determine the original keys, pitches are sampled from the sampled waveform data and the original keys are automatically set for the waveform data correspondingly to the sampled pitches (refer to Japanese Laid-Open Patent Publication (Kokai) No. 07-325579, for example).

A phrase sampler has been also proposed which samples phrase waveforms being performed, divides each of the sampled phrase waveforms into a plurality of partial waveform data according to an envelop level sampled from the sampled phrase waveform data to make performance while changing timing and pitch of each partial waveform data.

If tones being actually generated by performance are sampled and recorded and musical tones are generated using the recorded waveform data as is the case with the conventional sampler, tones are generated with poorer expression than tones actually generated by performance by musical instruments. In this case, it is impossible to obtain real musical tones even if waveform data is selected according to pitch information and touch information.

Further, according to the conventional sampler, since each waveform data for use in performance is recorded in the form of monotones, tones generated based upon the recorded waveform data are unnatural as is different from tones produced during performance of music. Specifically, the player needs to sequentially perform and record necessary monotones in a sampler during recording, but the player cannot easily perform only a monotone without getting nervous as compared with performance of a phrase. Particularly when a single tone is sung as a vocal, a voice may be uttered poorly or in a falsetto tone. Since it is difficult to record monotones in natural tone color, natural tones cannot be easily generated by performance by the sampler.

Further, when setting original keys for the recorded monotones, a person must determine the original keys or pitches must be sampled to determine the original keys. He or she, however, must be experienced to determine the original keys, and therefore, every person cannot determine the original keys. On the other hand, sampling the pitches requires complicated arithmetic operations, and moreover, the sampled pitches may cause one tone being generated by performance to be incorrectly recognized as multiple tones due to a change in pitch over time or may cause any of harmonic tones existing in some tones rich with harmonic components being generated by performance to be incorrectly determined as fundamental tones. Thus, the sampled pitches cannot always be correct. That is, even if the pitches are sampled, a person must finally confirm the sampled pitches.

Further, the conventional phrase sampler does not sample a pitch from waveform data when dividing a phrase waveform into partial waveforms. More specifically, a position at which a phrase waveform is divided into partial waveforms does not necessarily correspond to a point in change of pitch, and it is therefore impossible to set original keys for respective ones of partial waveform data. Further, to set original keys for partial waveform data with the dividing position being regarded as a point of change in pitch, the user needs to set the original keys or sample pitches from waveform data as mentioned above. This requires complicated operations as described above.

SUMMARY OF THE INVENTION

It is therefore a first object of the present invention to provide a waveform generating method, a performance data processing method, a waveform selection apparatus, a waveform data recording apparatus, and a recorded waveform reproducing apparatus, which are capable of generating expressive musical tones.

It is a second object of the present invention to provide a waveform generating method, a performance data processing method, a waveform selection apparatus, a waveform data recording apparatus, and a recorded waveform reproducing apparatus, which make it possible to record natural tones, divide recorded waveform data at points of change in pitch, and automatically assigning property information on pitch and the like to the divided waveform data.

It is a third object of the present invention to provide a waveform generating method, a performance data processing method, a waveform selection apparatus, a waveform data recording apparatus, and a recorded waveform reproducing apparatus, which are capable of obtaining natural performance tones.

To attain the first object, the present invention provides a waveform generating method comprising the steps of storing a plurality of partial waveforms in a partial waveform memory, storing property information on respective ones of the partial waveforms stored in the partial waveform memory, in a property information memory, retrieving the property information memory according to inputted sounding control information to read out a partial waveform having property information corresponding to the sounding control information, processing the readout partial waveform according to the property information and the sounding control information, and generating a waveform corresponding to the sounding control information.

To attain the first object, the present invention also provides a performance data processing method comprising the steps of storing property information on respective ones of a plurality of partial waveforms in a property information memory, comparing characteristics of respective ones of notes included in performance data with the property information stored in the property information memory to detect an optimum partial waveform for a characteristic of each of the notes, assigning designation data for designating the detected partial waveform to each of the notes, and storing performance data having the designation data assigned thereto.

To attain the first object, the present invention further provides a waveform generating method for use in reproducing the performance data having the designation data assigned thereto stored by the above-mentioned performance data processing method, comprising the steps of storing a plurality of partial waveforms in a partial waveform memory, reading out a partial waveform from the partial waveform memory according to the designation data assigned to each of the notes to be reproduced when reproducing the notes having the designation data assigned thereto according to the performance data, and generating a waveform corresponding to each of the notes based upon the read out partial waveform.

To attain the first object, the present invention yet further provides a waveform generating method comprising the steps of storing performance information corresponding to real-time performance, and generating accompanying tones by automatic performance or automatic accompaniment according to a tempo clock, reproducing performance information according to the tempo clock, and generating waveforms corresponding to performance events performed in real time to accompaniment of the generated accompanying tones, according to the performance events and the reproduced performance information.

To attain the first object, the present invention further provides a waveform selection apparatus comprising a partial waveform memory that stores a plurality of partial waveforms, a database that stores property data representing characteristics of two tones corresponding to each of the partial waveforms stored in the partial waveform memory and consisting of a tone corresponding to each of the partial waveforms and a preceding tone, and a retrieving device that retrieves the database according to characteristic data of two tones consisting of an inputted present tone to be generated by performance and an inputted preceding tone to be generated by performance before the inputted present tone to extract at least one partial waveform having property data close to the characteristic data of the inputted two tones as a partial waveform for sounding the inputted present tone to be generated by performance.

To attain the first object, the present invention further provides a waveform selection apparatus comprising a partial waveform memory that stores a plurality of partial waveforms, a database that stores property data representing characteristics of two tones corresponding to each of the partial waveforms stored in the partial waveform memory and consisting of a tone corresponding to each of the partial waveforms and a following tone, and a retrieving device that retrieves the database according to characteristic data of two tones consisting of an inputted present tone to be generated by performance and a following tone to be inputted and generated by performance before the inputted present tone to extract at least one partial waveform having property data close to the characteristic data of the inputted present tone and the following tone to be inputted as a partial waveform for sounding the inputted present tone to be generated by performance.

According to the waveform generating method of the present invention, it is possible to generate waveforms using the optimum partial waveforms correspondingly to sounding control information, and hence generate expressive musical tones.

Further, according to the performance data processing method of the present invention, it is possible to enable the optimum partial waveform data for characteristics of each note in the performance data to be selected in advance and assigned to each note in the performance data. The use of such performance data eliminates the necessity of selecting the optimum partial waveform data during waveform generation.

Further, according to the waveform generating method of the present invention, even when musical tones are generated by real-time performance, it is possible to control characteristics of musical tones generated by performance being currently made according to following performance to be subsequently made, by utilizing performance information corresponding to real-time performance.

Further, by selecting one or more partial waveforms having property data close to characteristic data of the following two tones, a present tone to be currently generated by performance and a preceding tone to be generated by performance before the present tone or a following tone to be generated by performance next to the present tone, the optimum partial waveforms can be selected as partial waveforms for generating musical tones by performance.

To attain the second object, the present invention provides a waveform data recording apparatus comprising an automatic performing device that reproduces performance data relating to phrases to be recorded, a waveform recording device that records phrase waveforms representing tones generated by performance based on tones generated by reproduction of the performance data by the automatic performing device, and a waveform data processing device that extracts data of the phrase waveforms recorded by the waveform recording device according to characteristic information on notes of the performance data to divide the data of the phrase waveforms into partial waveform data corresponding to respective ones of the notes.

Preferably, the waveform recording device records the phrase waveforms in synchronism with performance timing of the automatic performing device.

Also preferably, the waveform data processing device assigns the characteristic information on the notes corresponding to the partial waveform data as property information to the partial waveform data.

Preferably, the waveform data recording apparatus comprises a device that creates a tone color set from a partial waveform pool in which selected partial waveform data selected from the partial waveform data is pooled, and a partial waveform management database composed of the property information assigned to respective ones of the selected partial waveform data pooled in the partial waveform pool.

To attain the third object, the present invention also provides a recorded waveform data reproducing apparatus comprising a storage device that stores a tone color set from a partial waveform pool in which selected partial waveform data selected from the partial waveform data is pooled, and a partial waveform management database composed of property information assigned to respective ones of the selected partial waveform data pooled in the partial waveform pool, a detecting device that retrieves the partial waveform management database in the tone color set according to characteristic information on respective notes in performance data to detect optimum partial waveform data for each of the notes from the partial waveform pool, a designation data inserting device that embeds designation data for designating the optimum partial waveform data detected by the detecting device to each of the notes into the performance data, and a reproducing device that automatically reproduces the performance data in which the designation data is embedded by the designation data inserting device, according to the optimum partial waveform data designated by the designation data.

To attain the third object, the present invention further provides a recorded waveform data reproducing apparatus comprising a storage device that stores a tone color set from a partial waveform pool in which selected partial waveform data selected from the partial waveform data is pooled, and a partial waveform management database composed of property information assigned to respective ones of the selected partial waveform data pooled in the partial waveform pool, a detecting device that retrieves the partial waveform management database in the tone color set according to information on respective performance event data that have occurred, to detect optimum partial waveform data for each of the performance event data from the partial waveform pool, and a reproducing device that reproduces the performance event data according to the optimum partial waveform data detected by the detecting device.

To attain the third object, the present invention yet further provides a recorded waveform data reproducing apparatus comprising a storage device that stores a tone color set from a partial waveform pool in which selected partial waveform data selected from the partial waveform data is pooled, and a partial waveform management database composed of property information assigned to respective ones of the selected partial waveform data pooled in the partial waveform pool, a detecting device that retrieves the partial waveform management database in the tone color set according to characteristic information on respective notes in performance data read in advance to detect optimum partial waveform data for each of the notes from the partial waveform pool, and a reproducing device that is responsive to occurrence of performance event data corresponding to respective ones of the notes in the performance data, for reproducing performance tones corresponding to the respective ones of the notes according to the optimum partial waveform data detected by the detecting device.

According to the present invention constructed as above, it is possible to enable performance to be made while listening to tones generated by performance by the automatic performing device, and thus enable the player to make performance relaxedly and make recording of natural tones. By extracting the thus recorded phrase waveform data according to the automatically reproduced performance data, the phrase waveform data can be divided into partial waveform data corresponding to notes of the performance data. In this case, the dividing position is made more accurate by recording tones generated by performance in synchronism with the performance timing of the automatic performing device. Further, the characteristic information such as the pitch, length, intensity of a note corresponding to the partial waveform data obtained by the division can be assigned as property information to the corresponding partial waveform data. Further, desired partial waveform data can be selected from the partial waveform data obtained by the division and combined with the property information thereof to provide the tone color set for performance.

To make automatic performance based on the tone color set, the partial waveform management database of the tone color set is retrieved according to the pitch, length, intensity, etc. of each note in performance data for automatic performance to detect the optimum partial waveform data, and designation data for designating the detected partial waveform data to the note is embedded in the performance data. This enables automatic performance to be made with natural tones based on the processed performance data.

Further, to make real-time performance based on the tone color set, the partial waveform management data of the tone color set is retrieved according to information on generated performance event data to detect the optimum partial waveform, and the detected partial waveform data is used to reproduce performance tones of the performance event data, to thereby enable performance to be made with natural tones.

Further, to make performance based on the tone color set, the partial waveform management database of the tone color set is retrived according to the pitch, length, intensity, etc. of each note in performance data read in advance to detect the optimum partial waveform data, and upon occurrence of performance event data corresponding to respective ones of the notes in the performance data when the same part as the performance data is performed, performance tones corresponding to the respective notes are reproduced according to the detected optimum partial waveform data. This enables detection of conditions of following tones to be reproduced and hence enables performance to be made with more natural tones.

The above and other objects, features, and advantages of the invention will become more apparent from the following detailed description taken in conjunction with the accompanying drawings.

BRIEF DESCRIPTION OF THE DRAWINGS

FIGS. 2A and 2B are diagrams showing the relationship between automatically-reproduced performance data and phrase waveform data, which are synchronized, in the waveform data recording and reproducing apparatus, wherein:

FIG. 2A shows the performance data; and

FIG. 2B shows the phrase waveform data;

FIGS. 3A and 3B are diagrams showing modes of recording waveform data by the waveform data recording and reproducing apparatus according to the embodiment, wherein:

FIG. 3A shows the case where a player is listening to automatically-performance tones via a headphone; and FIG. 3B shows the case where a player is listening to automatically-performance tones via a speaker;

DETAILED DESCRIPTION OF THE PREFERRED EMBODIMENTS

The present invention will now be described in detail with reference to the drawings showing embodiments thereof.

Figure 1:
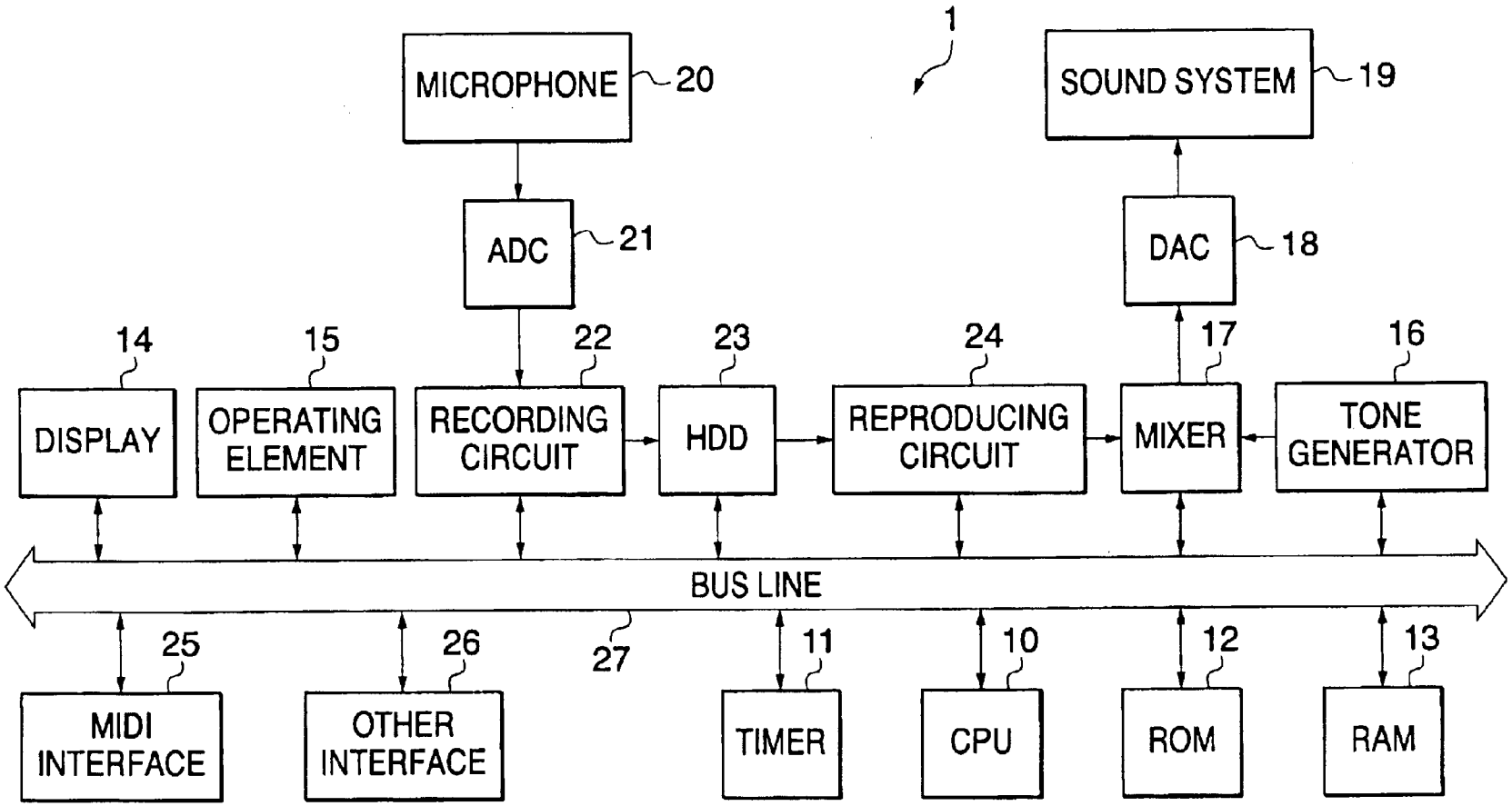
FIG. 1 is a diagram showing the hardware construction of a waveform data recording and reproducing apparatus that executes a waveform generating method and a performance data processing method according to an embodiment of the present invention.

FIG. 1 shows the hardware construction of a waveform data recording and reproducing apparatus that executes a waveform generating method and a performance data processing method according to an embodiment of the present invention.

In the waveform data recording and reproducing apparatus 1 in FIG. 1, a CPU 10 is a central processing unit that executes various kinds of programs to control recording and reproducing operations carried out by the waveform data recording and reproducing apparatus 1. A timer 11 is a timer that indicates elapsed time during operation and generates a timer interrupt at predetermined intervals, and is used for time management during automatic performance. A ROM 12 is a read only memory that stores programs for executing a dividing process and a property information assigning process carried out by the CPU 10 during recording, programs for executing a performance data processing process, a note-on event process, and the like carried out by the CPU 10 during reproduction, and various kinds of other data. A RAM 13 is a random access memory that serves as a main memory in the waveform data recording and reproducing apparatus 1, and as a work area and the like for the CPU 10 is set in the RAM 13.

A display 14 shows various kinds of information during recording and reproduction, and an operating element 15 is operated to perform various operations during recording and reproduction and may include a keyboard. A tone generator 16 generates musical tones based on performance data comprised of multiple phrases which are automatically performed during recording, and the tone generator 16 may be any one of an FM tone generator, a PCM tone generator, a harmonic synthesis tone generator, and so forth. A mixer 17 mixes musical tones generated by the tone generator 16 and musical tones reproduced by a reproducing circuit 24 described later, and transmits the mixed tones to a DAC 18. The DAC (Digital to Analog Converter) 18 converts musical tone data supplied from the mixer 17 into an analog musical tone signal, and transmits the analog musical tone signal to a sound system 19. The sound system 19 amplifies and sounds the musical tone signal supplied from the DAC 18.

A microphone 20 receives musical instrument tones generated by performance by a player or singing tones, i.e. melodies sung by a player, and a phrase waveform signal representing the received musical instrument tones or singing tones is transmitted to an ADC (Analog to Digital Converter) 21. The ADC 21 converts the waveform signal representing the supplied tones into digital phrase waveform data, and the resulting phrase waveform data is recorded in a HDD (Hard Disk Drive) 23 under the control of a recording circuit 22. As described later, the recorded phrase waveform data is divided into partial waveform data according to performance data reproduced by the tone generator 16 during recording, and the resulting partial waveform data has property information assigned thereto. Such dividing process and property information assigning process are carried out by the CPU 10 by executing programs for implementing these processes. Further, partial waveform data to be used is selected from the partial waveform data, and a performance tone color set is produced from property information assigned to the selected partial waveform data. The reproducing circuit 24 retrieves a partial waveform management database for a designated tone color in the tone color set, and acquires the optimum partial waveform data from the property information to generate performance waveform data. The generated performance waveform data is outputted as sounds from the sound system 19 via the mixer 17 and the DAC 18.

An MIDI interface 25 receives an MIDI signal that is outputted from an MIDI keyboard or the like conforming to the MIDI, so that the reproducing circuit 24 can generate performance waveform data as described above according to event data in the MIDI signal and the sound system 19 can sound performance tones. Another interface 26 is a communication interface for communication networks such as a LAN (Local Area Network), a public telephone network, and the Internet, and is connected to a server computer via a communication network so that desired performance data can be downloaded from the server computer. Reference numeral 27 denotes a bus line for use in sending and receiving signals between devices.

Referring next to FIGS. 2–6, a description will be given of a process for recording phrase waveform data and dividing it into partial waveform data in the waveform data recording and reproducing apparatus 1 according to the present embodiment.

Figure 3A:
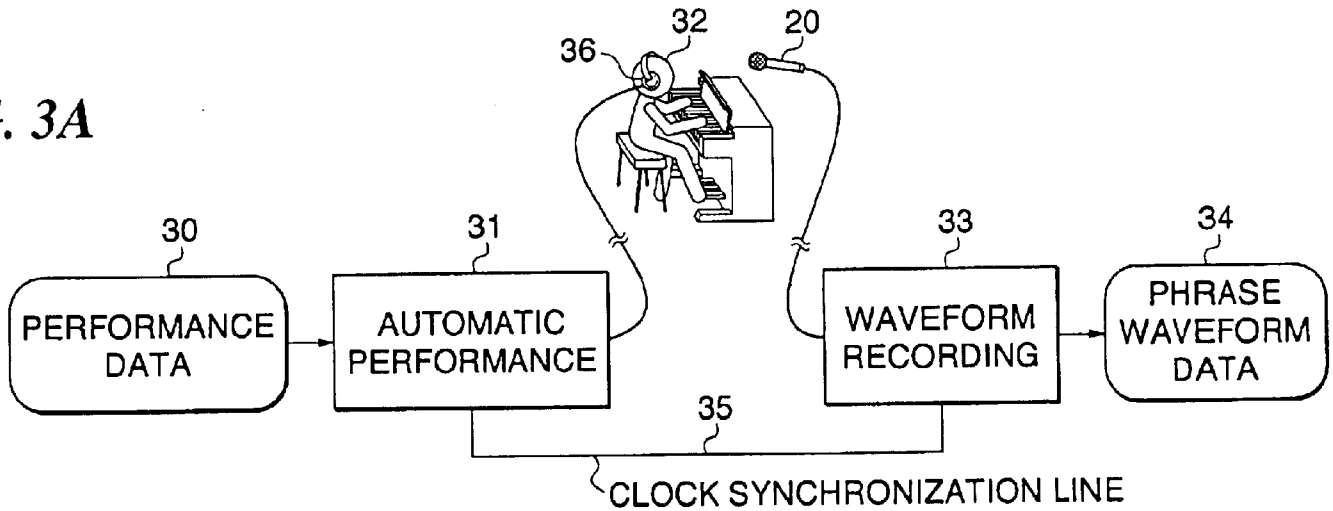

To record phrase waveform data by the waveform data recording and reproducing apparatus 1 according to the present embodiment, an automatic performing device 31 is supplied with performance data 30 composed of a plurality of phrases to make automatic performance as shown in FIG. 3A. The phrases include notes having characteristic information such as pitch desired for recording. The automatic performing device 31 is comprised mainly of the CPU 10 and the tone generator 16 in FIG. 1. The CPU 10 executes an automatic performance program to generate tone generator parameters according to performance data readout from the ROM 12 or the RAM 13. The tone generator parameters are supplied to the tone generator 16 to cause the performance waveform data generated by the tone generator 16 to be sounded from a headphone 36 connected to the sound system 19 via the mixer 17 and the DAC 18. A player 32 mounts thereon the headphone 36 so that he or she can listen to tones being generated by performance via the headphone 36. It should be noted that sequence data, which is, for example, in the SMF (Standard MIDI File) format or the like and comprised of phrases for one or more parts including performance data for one or more parts desired to be recorded or performance data for other parts, is prepared in advance and stored as performance data in the RAM 13 or the like.

While listening to tones being generated by performance based on the performance data, the player 32 performs a musical instrument, not shown, or sings a song according to the performance tones. Since the player 32 performs a musical instrument or sings a song while listening to the performance tones, the performance tones or singing tones can be natural. Phrase waveforms representing the performance tones or singing tones are supplied to a waveform recording device 33 via a microphone 20, and are sampled into digital phrase waveform data 34 and recorded on a phrase-by-phrase basis. On this occasion, a clock synchronization line 35 synchronizes clocks of the automatic performing device 31 and the waveform recording device 33, so that phrase waveform data can be recorded in synchronism with performance timing. This synchronization is carried out by using the same clock for a sampling clock of the waveform recording device 33 and an operating clock of the automatic performing device 31, and making the automatic performance starting timing and the recording starting timing coincide with each other or storing a difference between the two kinds of timing. This ensures the recorded phrase waveform data 34 and the automatically reproduced performance data to be synchronized over all sections thereof. Thus, even a change in the tempo of the performance data would not affect the synchronization at all.

Figures 2A, 2B:
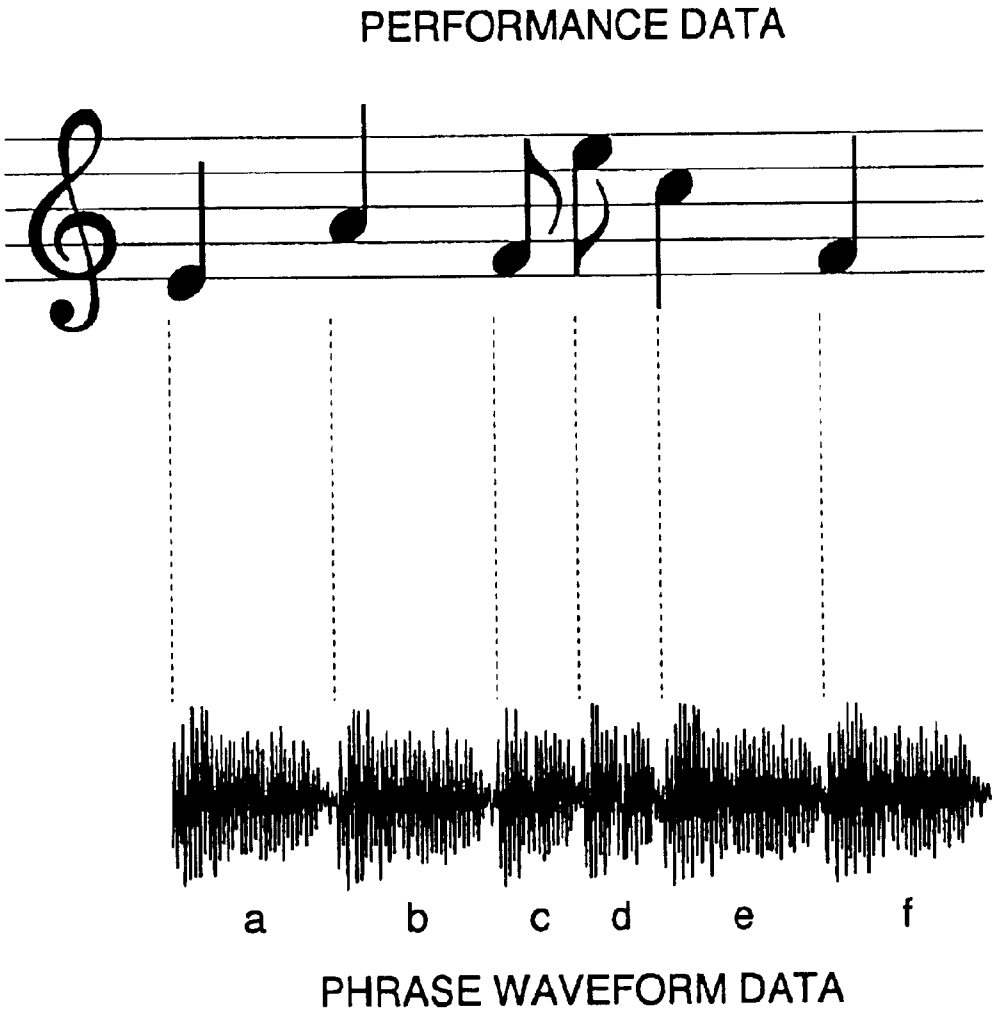

FIGS. 2A and 2B show the outline of the relationship between the automatically reproduced performance data and the phrase waveform data. The performance data is represented by notes on a score as shown in FIG. 2A, and FIG. 2B shows phrase waveforms recorded by performance or singing in accordance with automatic performance tones based on the performance data listened to via the headphone 36. In this case, a quarter note "E" in the performance data corresponds to a waveform a, a quarter note "A" in the performance data corresponds to a waveform b, an eighth note "F" in the performance data corresponds to a waveform c, an eighth quarter "E" in the performance data corresponds to a waveform d, a quarter note "C" in the performance data corresponds to a waveform e, and a note "F" in the performance data corresponds to a waveform f. Due to the synchronization as described above, each waveform corresponds to the performance timing of the performance data, and has a tone length corresponding to a note. Further, the tone color of each waveform is natural since the player makes performance while listening to the performance tones based on the performance data, though this is not seen from the waveforms.

The waveform recording device 33 is comprised of the CPU 10, the ADC 21, the recording circuit 22, and the HDD 23 in FIG. 1. Under the control of the CPU 10, the waveform recording device 33 converts phrase waveforms representing performance tones or singing tones inputted from the microphone 20 into the digital phrase waveform data 34. The phrase waveform data 34 is written into a predetermined storage area of the HDD 23 by the recording circuit 22. It should be noted that automatic performance may be carried out in any of modes described below. The first automatic performance mode is a solo-part performance based on performance data comprised only of a part desired for recording (recording part) in a phrase. The second automatic performance mode is an all-part performance based on performance data comprised of a plurality of parts including a part desired for recording in a phrase. The third automatic performance mode is a minus-one performance based on performance data comprised of one or more parts except for a part desired for recording in a phrase, or comprised of the above-mentioned other parts.

Figure 3B:
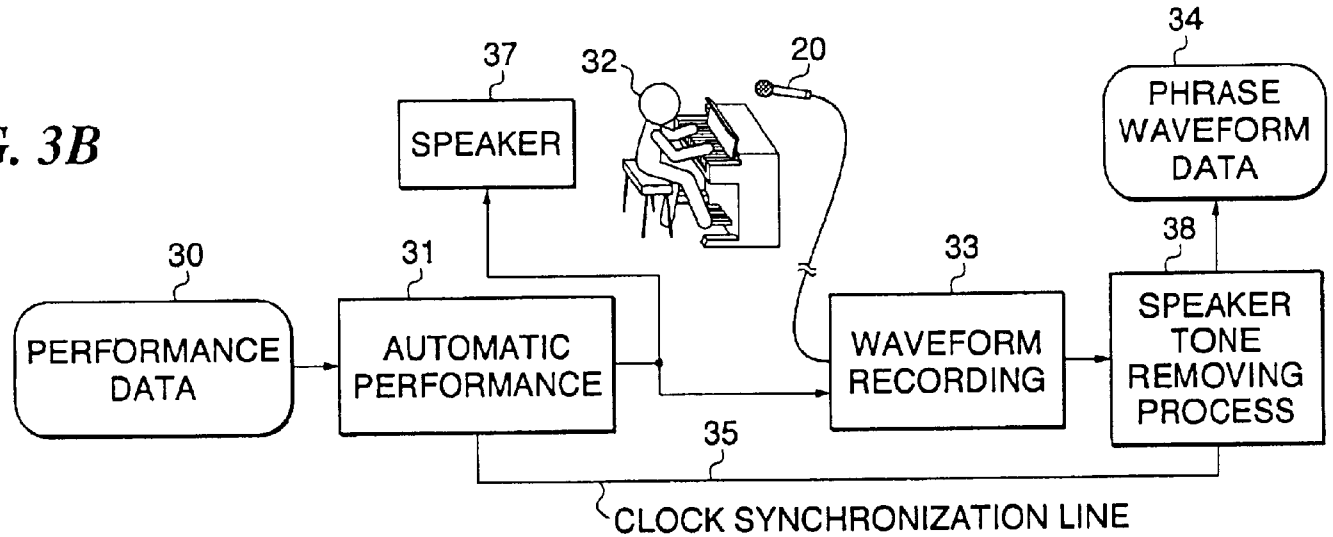

The waveform data recording and reproducing apparatus 1 according to the present embodiment may record the phrase waveforms using the arrangement in FIG. 3B. In the arrangement shown in FIG. 3B, the player 32 is listening to tones being generayed by automatic performance via a speaker 37 instead of the headphone 36. A description will now be given only of parts of the arrangement different from FIG. 3A. Automatic performance tones outputted from the automatic performing device 31 are sounded via the speaker 37 and audited by the player 32. On this occasion, the automatic performance tones sounded via the speaker 37 are picked up by the microphone 20, and thus, a speaker tone-removing device 38 removes the automatic performance tones picked up by the microphone 20. It should be noted that the speaker tone removing device 38 is supplied with automatic performance tones from the automatic performing device 31, and the automatic performance tones are removed by inverting the phase of the automatic performance tones and carrying out time adjustment/amplitude adjustment.

Since the waveform recording device 33 samples tones generated by performance or singing by the player 32 with the automatic performance device 31 set in any one of the above described modes of automatic performance, the recorded phrase waveform data always includes performance data (corresponding performance data) for waveform division corresponding to parts desired for recording (recording parts).

Figure 4:
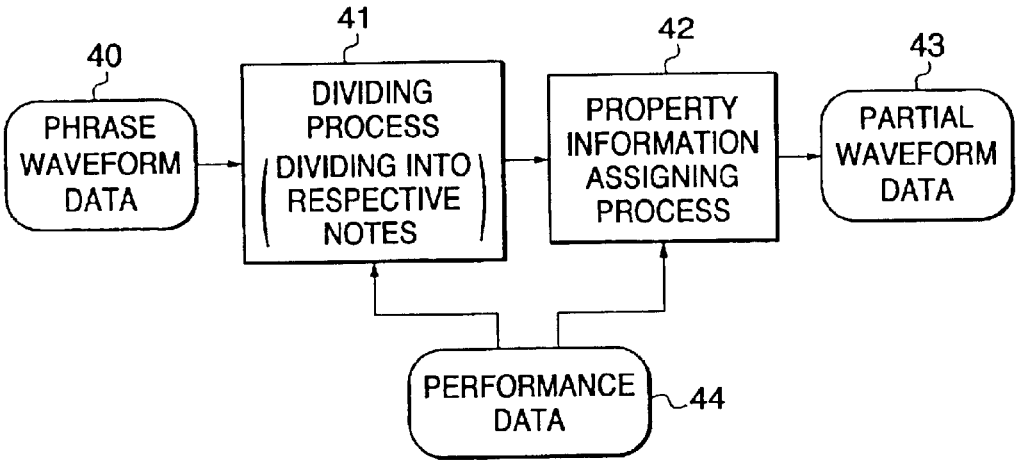
FIG. 4 is a schematic diagram showing a phrase waveform data processing process and a property information assigning process carried out by the waveform data recording and reproducing apparatus according to the embodiment.

Accordingly, as shown in FIG. 4, a dividing device 41 divides phrase waveform data 40 into partial waveform data 43 corresponding to respective notes in performance data 44 according to the automatically reproduced performance data 44. A property information-assigning device 42 then assigns to the resulting partial waveform data 43 property information representing properties such as pitch, tone length and intensity of the respective notes while referring to characteristic information on the respective notes in the corresponding performance data 44. The CPU 10 executes a dividing process program and a property information assigning process program to cause the dividing device 41 to divide the phrase waveform data 40 into the partial waveform data 43 and cause the property information-assigning device 42 to assign property information to the divided partial waveform data 43.

In this case, since the phrase waveform data 40 is synchronous with the performance data 44, it is possible to divide the phrase waveform data 40 into the partial waveform data 43 only according to sounding timing or the like of the performance data 44. Further, the dividing position of the phrase waveform data 40 may be corrected by frequency analysis (formant analysis). More specifically, a start position of a formant in the partial waveform data 43 is searched for based upon a provisional dividing position provisionally determined according to the performance data 44, and the detected start position is determined as the dividing position. This enables the phrase waveform data 40 to be divided at more musically accurate positions as compared with a dividing method based only upon results of analysis of the phrase waveform data 40.

To be more specific, the dividing method based only upon the performance data 44 assumes that the automatically reproduced performance data 44 and the phrase waveform data 40 are completely synchronized. Thus, according to data of each note contained in the performance data for a recording part, a portion of the phrase waveform data 40 for a time range corresponding to the note (from start timing of a tone corresponding to the note (note-on) to the time point of attenuation of the tone or to the start of a tone of the next note after the start of releasing of the tone (note-off)) can be extracted or cut out as each piece of partial waveform data 43.

Since the phrase waveform data 40 is obtained by sampling the performance made by a person, however, the start timing of some notes in the performance data 44 for the recording part does not necessarily coincide with the start timing of waveforms corresponding to the notes and may be different from the latter.

To accurately extract or cut out the partial waveform data 43, with reference to start timing of each note in the performance data for the recording part, waveforms of the phrase waveform data 40 in sections just before and after the above start timing (e.g. sections over several seconds before and after the start timing) are analyzed, and the start timing of the note in the phrase waveform data 40 is detected based upon the analysis results, to thereby correct the dividing position.

A waveform analyzing method for use in correcting the dividing position can be based upon formant analysis and FFT analysis. In the formant analysis, with reference to start timing of each note in the performance data for the recording part, an LPC (Linear Prediction Coding) coefficient is calculated from a correlation function of waveform data in sections just before and after the above start timing of the phrase waveform data 40. The LPC coefficient is then converted into a formant parameter to find a formant in the phrase waveform data 40. The start timing of the note is detected from a rising position of the formant corresponding to the note. This enables the phrase waveform data 40 to be divided into the partial waveform data 43 for respective notes at musically accurate positions.

In the FFT (Fast Fourier Transform) analysis, with reference to start timing of each note in the performance data for the recording part, sections just before and after the above start timing of the phrase waveform data 40 are subjected to the fast fourier transformation while shifting a time window. The loci of a fundamental tone and multiple harmonic tones corresponding to the note are detected, and the start timing is detected based on a rising position in the detected loci of the fundamental tone and harmonic tones. This method enables the partial waveform data 43 to be divided into the partial waveform data 43 for respective ones of notes at musically accurate positions. Although in the above description, as the waveform analyzing method, the formant analysis and the FFT analysis were given, other analyzing methods such as pitch analysis and envelope analysis may be adopted to correct the dividing position.

Upon completion of the dividing process, a property information assigning process is carried out to assign property information to respective partial waveform data obtained by the division. In the property information assigning process, the partial waveform data 43 corresponding to respective notes in the performance data 44 have assigned thereto property information corresponding to character information of the notes. The property information includes one or more kinds of information among pitch information used as original keys, intensity information used as original intensity, tone length information used as original tone length, preceding tone information and following tone information used for selecting partial waveform data. It should be noted that the preceding tone information is information indicating whether the pitch of the preceding tone is higher or lower than that of the present tone or information on a difference in pitch between the preceding tone and the present tone, information indicating whether the intensity of the preceding tone is higher or lower than that of the present tone or information on a difference in intensity between the preceding tone and the present tone, information indicating whether the tone length of the preceding tone is longer or shorter than that of the present tone or information on a difference in tone length between the preceding tone and the present tone, and other information relating to the relationship between preceding tone and the present tone. In this case, the preceding tone may be in plurality, for example, two tones before the present tone. The following tone information is information relating to the relationship between the following tone and the present tone in the case where the preceding tone in the preceding tone information is replaced by the following tone. Further, if the performance data includes musical symbols representing slur, trill, and crescendo, such musical symbols may be included in the property information. The property information is used as a reference in selecting partial waveform data, and is used as a parameter in processing partial waveform data. It should be noted that partial waveform data corresponding to the desired property information can be obtained by recording with notes corresponding to the desired property information being included in performance data.

Figure 5:
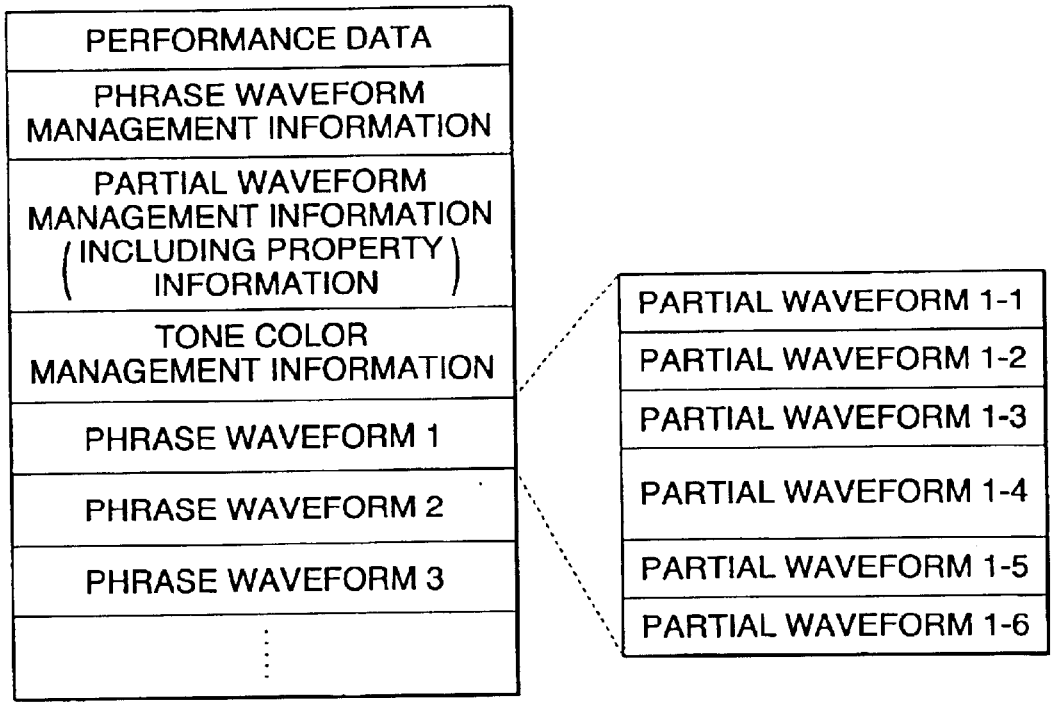
FIG. 5 is a diagram showing the structure of data recorded in the waveform data recording and reproducing apparatus according to the embodiment.

As shown in FIG. 4, the dividing device 41 divides the phrase waveform data 40 into the partial waveform data 43, and the property information assigning means 42 assigns the property information to the divided partial waveform data 43. The partial waveform data 43 obtained by the division and the assigned property information are stored as one recorded data together with the performance data in the HDD 23. Since the phrase waveform data 40 is recorded for each type of musical instruments and each vocal tone color, the data is recorded for each tone color. FIG. 5 shows the structure of the data recorded in the HDD 23. As shown in FIG. 5, the recorded data is comprised of performance data composed of phrases which were automatically performed, phrase waveform management information for managing a location in the storage area where phrase waveform data corresponding to performance data for each phrase is stored, partial waveform management information composed of a start position and end position in the storage area of partial waveform data divided from phrase waveform data and property information of the partial waveform data, and a phrase waveform 1, a phrase waveform 2, . . . corresponding to performance data for respective phrases. Data of each phrase waveform is divided into a plurality of partial waveform data in the above-described method, and details of partial waveform data divided from the phrase waveform 1 is illustrated in FIG. 5 as an example. Specifically, the phrase waveform 1 is divided into six partial waveform data: a partial waveform 1-1, a partial waveform 1-2, . . . , a partial waveform 1-6.

The recorded data in FIG. 5 is obtained by dividing phrase waveform data recorded for each performance data and assigning property information to the resulting partial waveform data. The phrase waveform data is recorded for each type of musical instruments or each vocal tone color. Thus, the recorded data is produced for each tone color. Therefore, to obtain performance waveform data for a certain tone color, corresponding partial waveform data is read out from the recorded data according to performance event data and used. The partial waveform data in the recorded data in FIG. 5, however, may include a plurality of partial waveform data with the same property information such as pitch, and unnecessary partial waveform data. Therefore, partial waveform data to be used is selected from the recorded data to produce a performance tone color set for use in performance, based on the selected partial waveform data. To produce the tone color set, selecting information indicating which partial waveform data is to be selected, tone color parameters, and the like are contained in the recorded data as tone color management information, and the tone color set is produced according to the tone color management information. For this reason, the recorded data in FIG. 5 can be called a tone color set producing tool. The tone color management information includes selecting information for selecting partial waveform data according to the user's request, tone color parameters set by the user, and so forth.

Figure 6:
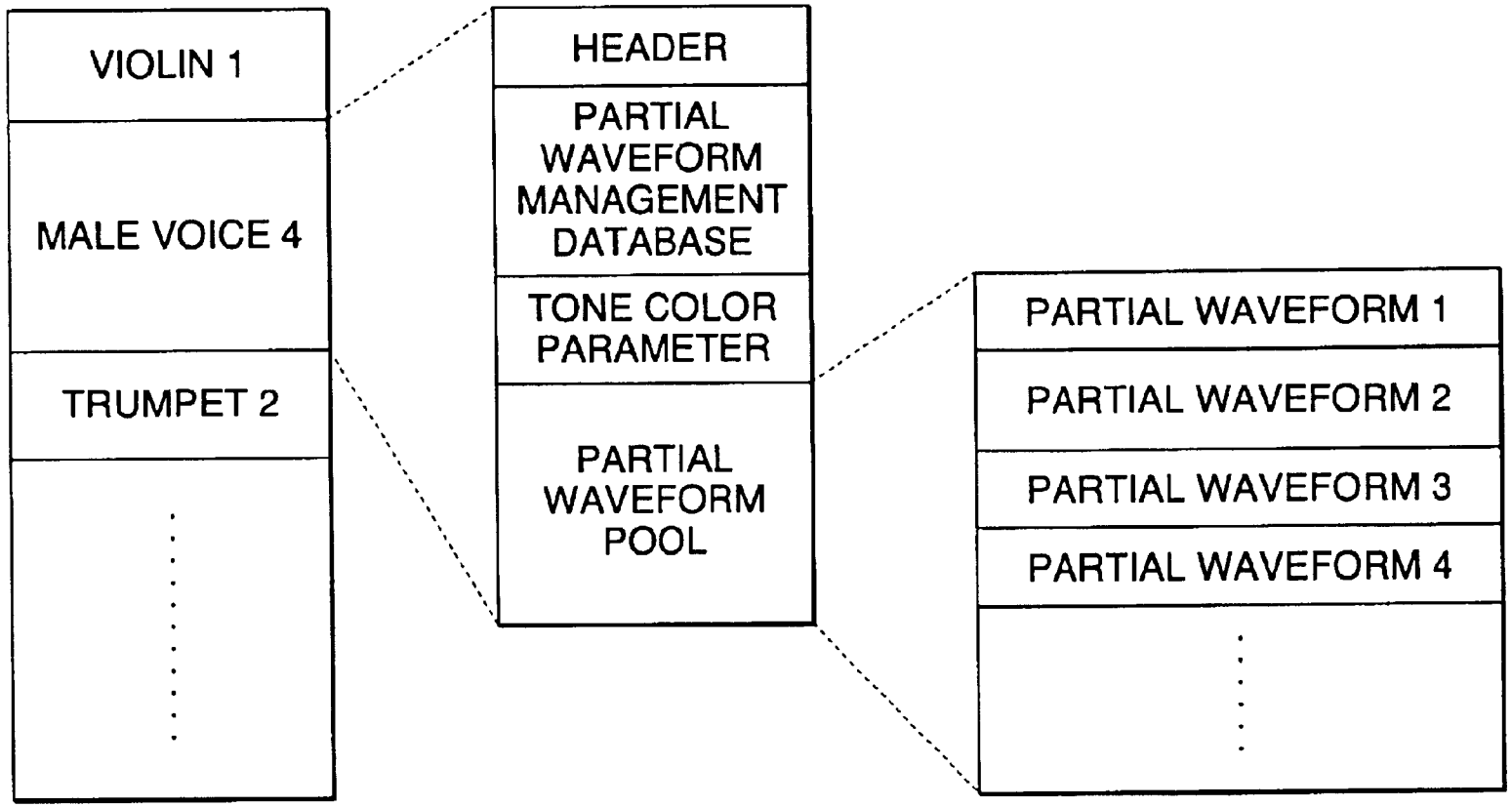
FIG. 6 is a diagram showing the structure of a performance tone color set in the waveform data recording and reproducing apparatus according to the embodiment.

FIG. 6 shows an example of the structure of data in the tone color set. The performance tone color set shown in FIG. 6 is comprised of tone color data for each tone color such as "violin 1", "male voice 4", "trumpet 2", . . . Every tone color data has the same structure. For example, the structure of tone color data of "male voice 4". As shown in FIG. 6, the tone color data is comprised of a header, a partial waveform management database, tone color parameters, and a partial waveform pool. In the partial waveform pool, partial waveform data selected from a plurality of phrase waveform data according to the tone color management information in the recorded data in FIG. 5 is pooled as a partial waveform 1, a partial waveform 2, a partial waveform 3, . . . as shown in FIG. 6. In this case, if partial waveform data corresponding to many pitches are selected according to the tone color management information, it is possible to finely set a range to which are assigned the partial waveform data. Also, the tone color management information may be such information as enables selection of partial waveform data including the same pitch information but different tone length information or intensity information, or partial waveform data including different information on the difference in pitch between the preceding tone and the present tone or different information indicating whether the pitch of the preceding tone is higher or lower than that of the present tone.

The partial waveform management database in the tone color set produced in the above-mentioned manner has recorded therein information indicating a start position and an end position of partial waveform data selected according to the tone color management information in the storage area for the partial waveform pool and property information of the partial waveform data. The tone color parameters included in the tone color management information are directly stored in a tone color parameter storage area, and an envelop parameter and a filter coefficient for a corresponding tone color are recorded as the tone color parameters.

A plurality of tone color data, which are each produced for each tone color in the tone color set, can be produced from one recorded data by selecting different combinations of partial waveform data from the recorded data in FIG. 5. The waveform data recording and reproducing apparatus 1 according to the present invention is capable of making automatic performance and real-time performance using the tone color set thus produced.

Figure 7:
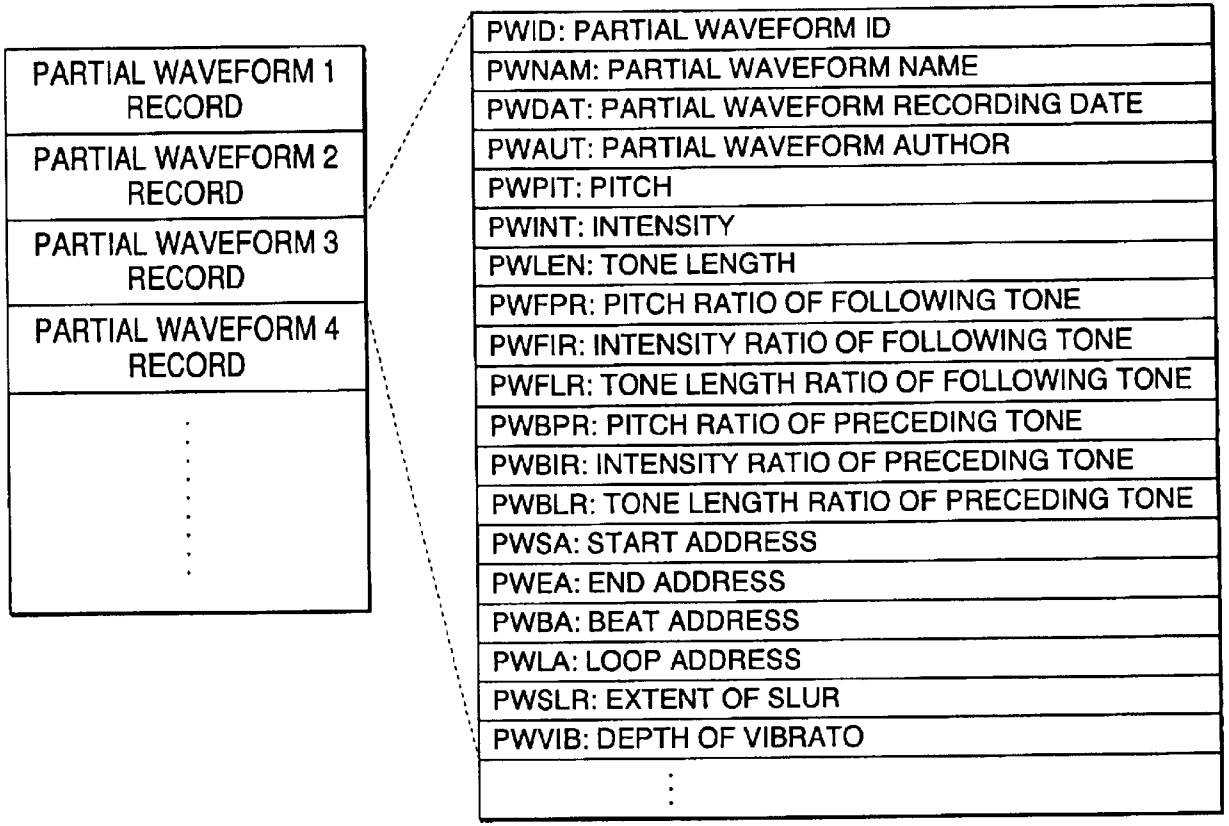
FIG. 7 is a diagram showing the detailed structure of a partial waveform record in the performance tone set in the waveform data recording and reproducing apparatus according to the embodiment.
Figure 8:
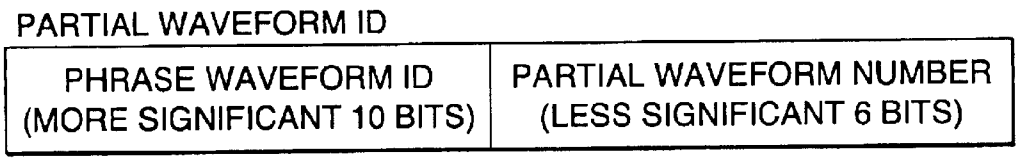
FIG. 8 is a diagram showing the structure of a partial waveform ID of a partial waveform record in the performance tone color set in the waveform data recording and reproducing apparatus according to the embodiment.

FIG. 7 shows the structure of data in the partial waveform management database which stores property information and the like of partial waveforms selected according to the tone color management information stored in the partial waveform pool. The partial waveform management database is comprised of record information such as a partial waveform 1 record, a partial waveform 2 record, a partial waveform 3 record, a partial waveform 4 record, . . . representing characteristics of respective partial waveforms such as the partial waveform 1, the partial waveform 2, the partial waveform 3, the partial waveform 4, . . . stored in the partial waveform pool. Every record information has the same data structure, and FIG. 7 shows the details of data structure of the partial waveform 3 record. Specifically, the record information represented by the partial waveform 3 record includes a partial waveform ID (PW (Partial Wave) ID), a partial waveform name (PWNAM), a partial waveform producing date (PWDAT), and a partial waveform author (PWAUT). As shown in FIG. 8, the partial waveform ID is comprised of a phrase waveform ID (more significant 10 bits) and a partial waveform ID (less significant 6 bits). It should be noted that the phrase waveform ID is an ID of a phrase waveform from which the partial waveform has been cut out, and the partial waveform number is a number indicating when the partial waveform was cut out from the phrase waveform. The partial waveform ID thus constructed can specify a phrase waveform from which a partial waveform is cut out, and makes it possible to confirm the type of the phrase waveform from which a partial waveform has been cut out, by listening to tones represented by the phrase waveform when the user selects the partial waveform.

Further, each record information includes a variety of information on tone pitch (PWPIT), intensity (PWINT), tone length (PWLEN) of partial waveform data, a pitch ratio (PWPFR) representing the relationship in pitch between the present tone and the following tone, an intensity ratio (PWFIR) between the present tone and the following tone, a tone length ratio (PWFLR) between the present tone and the following tone, a pitch ratio (PWBPR) representing the relationship in pitch between the preceding tone and the present tone, an intensity ratio (PWBIR) between the preceding tone and the present tone, and a tone length ratio (PWBLR) between the preceding tone and the present tone. Among these information, the information relating to the ratios may alternatively be replaced by information on differences.

Further, each record information includes a start address (PWSA), end address (PWEA), beat address (PWBA), and loop address (PWLA) of a corresponding partial waveform in the storage area for the partial waveform pool. In this case, the start address and the end address are essential information, but the beat address and the loop address should not always be included in the record information. It should be noted that the beat address represents a beat position (a position where a beat is felt) in the partial waveform, and the beat position is set to correspond to the timing of a note in the performance data when the partial waveform data is used. To use the beat address is favorable in the case where the start position of each performed note is not clear when performance data is softly performed. The loop address is an address of a loop waveform in the case where a constant portion with a small change in a partial waveform is replaced by a repeated loop waveform. It should be noted that even if the partial waveform is shortened by looping, this does not cause a change in tone length information of the partial waveform. Thus, the tone length (PWLEN) information is information that does not indicate the length of waveform data but indicates the length of a note when the tone of the waveform data is generated by performance.

The partial waveform management database includes the extent of slur (PWSLR), the depth of vibrato (PWVIB), and other information.

It should be noted that the partial waveform management database may be separated into a database that stores address information such as start addresses, end addresses, etc. of partial waveforms, and a database that stores the rest of information on partial waveforms for use in retrieving partial waveforms. In this case, the latter database for retrieval is only required for selecting partial waveforms, and the processing carried out by CPU 10 can be reduced by integrating the former address information database in the tone generator 16.

Figure 9:
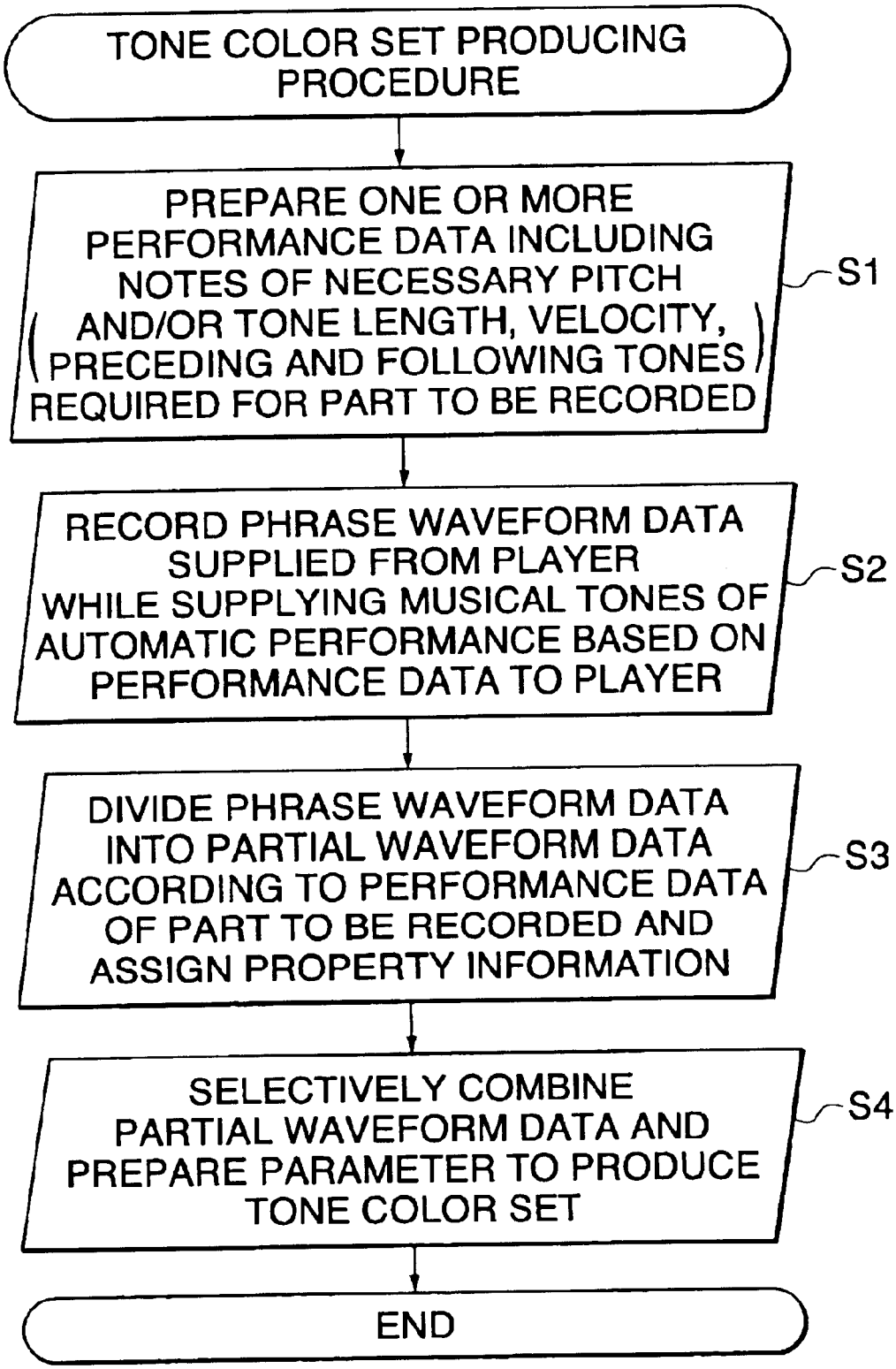
FIG. 9 is a flow chart showing the procedure for producing the tone color set in the waveform data recording and reproducing apparatus according to the embodiment.

Referring next to a flow chart of FIG. 9, a description will now be given of the procedure for producing the tone color set for use in performance shown in FIGS. 6–8 using the tone color set producing tool having the data structure as shown in FIG. 5. It should be noted that the user who produces the tone color set carries out this procedure.

First, the user who produces the tone color set prepares and stores performance data comprised of a plurality of phrases including at least a high-pitch note required for a recording part in the performance data storage area in FIG. 5 (step S1). On this occasion, the performance data may be comprised of phrases including notes having characteristic information required for recording, i.e. information on tone pitch, tone length, velocity, preceding tone information, difference in pitch between the preceding tone and the present tone, etc. Then, while musical tones generated by automatic performance by the waveform data recording and reproducing apparatus 1 based upon the performance data comprised of a plurality of phrases thus prepared are supplied to the player, phrase waveforms generated by performance or singing by the player are recorded in necessary ones of the phrase waveform storage areas of the waveform data recording and reproducing apparatus 1 shown in FIG. 5 (step S2).

The waveform data recording and reproducing apparatus 1 divides the recorded phrase waveform data into partial waveform data according to the performance data in the recorded data, and assigns property information relating to notes corresponding to the partial waveform data obtained by the division to the partial waveform data. The start position and end position of each partial waveform data obtained by the division and the property information assigned to the partial waveform are stored as partial waveform management information for each partial waveform in the partial waveform management information storage area in FIG. 5 (step S3). According to operating element operation by the user, the partial waveform data are selectively combined, and tone color parameters such as an envelope parameter are prepared. Selecting information indicating the selected partial waveform data and the prepared tone color parameters are stored as tone color management information in the tone color management information storage area in FIG. 5 (step S4).

According to the tone color data for one tone color completed in the steps S1 to S4, tone color data for one tone color in the tone color set in FIG. 6 is prepared and stored in a storage area in a manner described below. First, partial waveform data selected from a plurality of partial waveform data stored in the phrase waveform storage areas in FIG. 5 according to the selecting information in the tone color management information is copied in a partial waveform pool for the tone color in FIG. 6, and the start position and end position of each copied partial waveform data and property information including the ID, name, author, etc. of each copied partial waveform data are stored in the partial waveform management database in FIG. 6. The tone color parameters in the tone color management information in FIG. 5 are copied in a tone color parameter storage area for the tone color in FIG. 6. Finally, header information indicating the tone color type, tone color name, tone color data capacity, etc. of the tone color are stored in the header area in FIG. 6 to complete the tone color data in the tone color set for use in performance.

It should be noted that in the step S3, after a position of dividing the phrase waveform data into the partial waveform data and property information to be assigned are automatically determined, the user may arbitrarily correct the dividing position and the property information.

Figure 10:
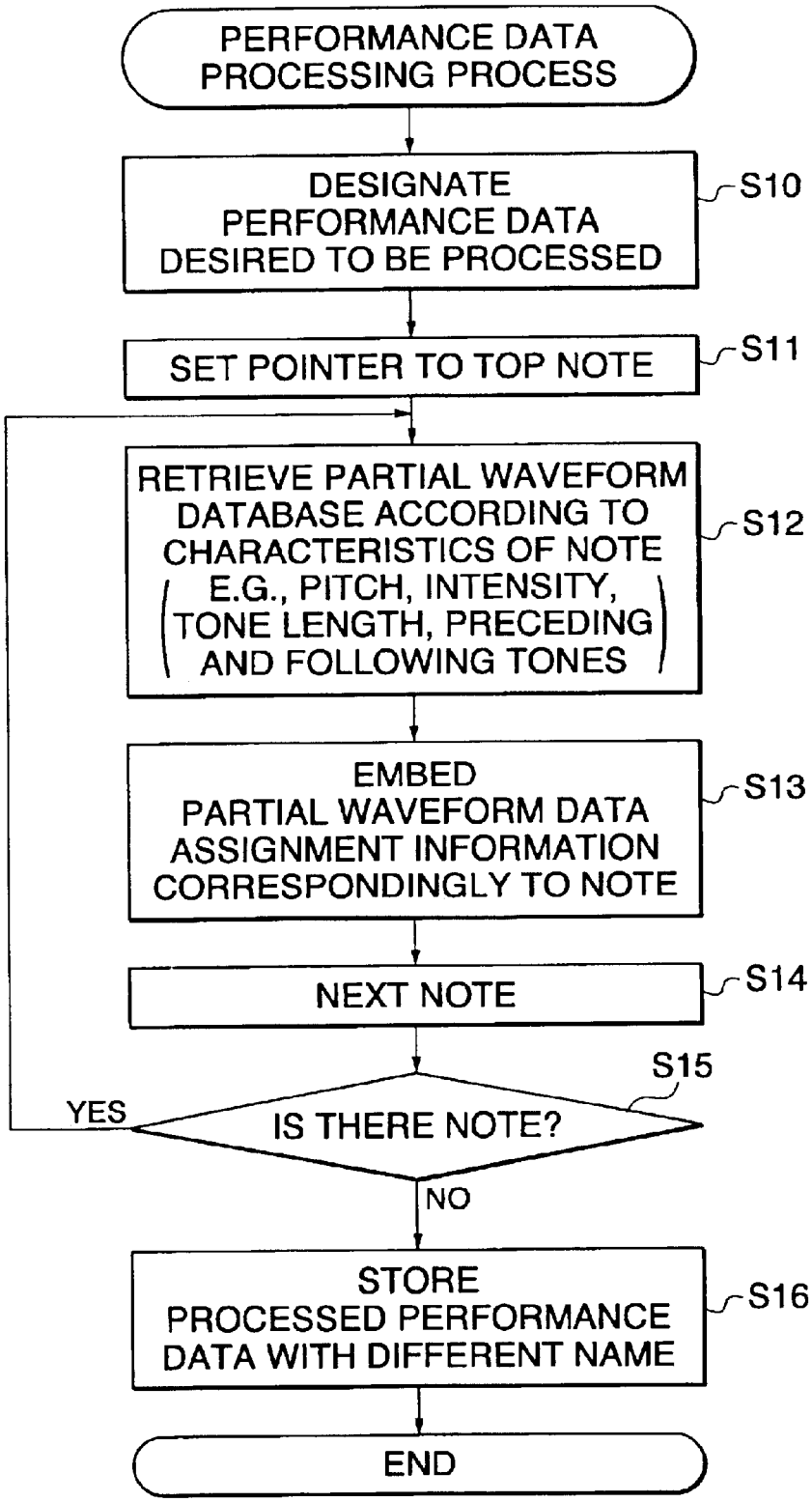
FIG. 10 is a flow chart showing a performance data processing process carried out by the waveform data recording and reproducing apparatus according to the embodiment.

To apply the performance tone color set in FIG. 6 to automatic performance in the waveform data recording and reproducing apparatus 1, performance data is processed in advance prior to the automatic performance. The performance data is arbitrary performance data which is desired for automatic performance by the user. FIG. 10 shows a flow chart showing a performance data processing process when the tone color set is applied to automatic performance, and a description thereof will be given hereinbelow.

Upon start of the performance data processing process in FIG. 10, performance data to be processed is designated in a step S10. The user designates performance data desired for automatic performance among performance data stored in the ROM 12 or the RAM 13. In the following description, the performance data is monophonic performance data composed of one part in order to simplify the description. In the next step S11, a pointer is set to a top note in the designated performance data. In the next step S12, search information in the partial waveform management database for the designated tone color in the tone color set is searched according to characteristic information such as the pitch, intensity (velocity), length, pitch ratio between the present tone and the following tone, intensity ratio between the present tone and the following tone, and tone length ratio between the present tone and the following tone for a note indicated by the pointer (at this time, the top note in the performance data), to detect the optimum partial waveform data.

In the next step S13, designation information for designating the optimum partial waveform data detected correspondingly to the note indicated by the pointer is embedded in the performance data. Specifically, designation information for designating partial waveform data such as a meta event and a system exclusive message is inserted just before performance event data corresponding to the note. In the next step S14, the pointer is moved to the next note, and in a step S15, it is determined whether a note is present or not at a position to which the pointer has been moved. If a note is present, the program returns to the step S12. Thus, the process from the steps S12 to S15 is then repeatedly carried out, so that designation information for designating the optimum partial waveform data corresponding to one note is embedded in the performance data each time the process is carried out. After completion of embedment of designation information for designating the optimum partial waveform data corresponding to the last note in the performance data, it is determined in the step S5 that no note is present, and then the process proceeds to a step S16. In the step S16, the performance data in which the designation information on the partial waveform data is embedded in the above-mentioned manner is stored with a different name. This completes the performance data processing process.

If the thus processed performance data is designated and automatically performed by the waveform data recording and reproducing apparatus 1, in start timing of each note in the performance data, partial waveform data specified by the designation information embedded just in front of a note-on event of the note is read out from the HDD 23 and transmitted to the reproducing circuit 24 together with tone color parameters corresponding to the note-on event. In this manner, the performance data is automatically performed to generate musical tones corresponding to respective notes in the specified partial waveform data.

Although the designation information for designating the partial waveform data is embedded as a meta-event and a system exclusive message, the designation information may be embedded as other kinds of events.

Further, if performance data desired for automatic performance is comprised of a plurality of parts, the process in FIG. 10 may be carried out for only one desired part among the plurality of parts, or may be carried out for desired two or more parts.

Further, the process in FIG. 10 is carried out not only for monophonic performance data but also for performance data having a plurality of notes overlapping at the same time. However, if partial waveform data is desired to be selected according to characteristic information indicating whether the pitch of the preceding tone or the following tone is higher or lower than that of the present tone, a difference in pitch between the preceding tone or the following tone and the present tone, or the like, all of performance data to be processed must be monophonic.

Figure 11:
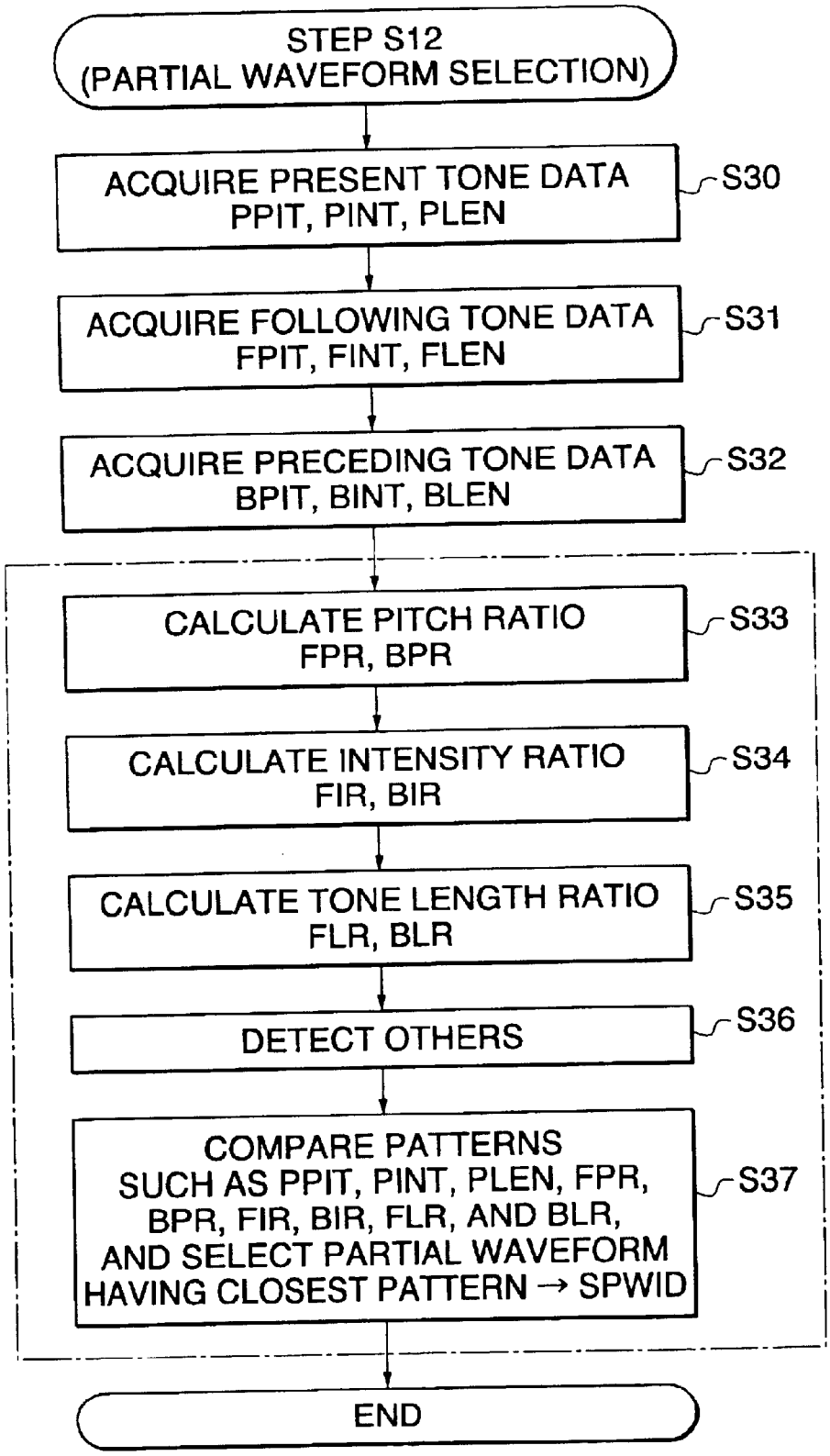
FIG. 11 is a flow chart showing a process in a step S12 in the flow chart of FIG. 10.

FIG. 11 is a flow chart showing the details of the partial waveform selecting process carried out in the step S12 in the performance data processing process in FIG. 10.

In the partial waveform selecting process in FIG. 11, present tone data such as present tone pitch (PPIT), present tone intensity (PINT), and present tone length (PLEN) are acquired in a step S10. Next, following tone data such as following tone pitch (FPIT), following tone intensity (FINT), and following tone length (FLEN) are acquired in a step S31. Further, preceding tone data such as preceding tone pitch (BPIT), preceding tone intensity (BINT), and preceding tone length (BLEN) are acquired in a step S32. A following tone pitch ratio (FPR) and a preceding tone pitch ratio (BPR) are then calculated according to the following equations (1) and (2):

$$FPR=(FPIT-PPIT)/PPIT \quad (1)$$

$$BPR=(BPIT-PPIT)/PPIT \quad (2)$$

Further, a following tone intensity ratio (FIR) and a preceding tone intensity ratio (BIR) are calculated according to the following equations (3) and (4):

$$FIR=(FINT-PINT)/PINT \quad (3)$$

$$BIR=(BINT-PINT)/PINT \quad (4)$$

Further, a following tone length ratio (FLR) and a preceding tone length ratio (BLR) are calculated according to the following equations (5) and (6):

$$FLR=(FLEN-PLN)/PLEN \quad (5)$$

$$BLR=(BLEN-PLEN)/PLEN \quad (6)$$

Further, other parameters are detected in a step S36. In this detection, the extent of slur is detected and the vibration width of pitch bend data is detected as the depth of vibrato according to a period of time in which the present tone overlaps the following tone, variations of intensity in a plurality of preceding and following tones, and the like.

The information such as the present tone pitch (PPIT), the present tone intensity (PINT), the present tone length (PLEN) obtained in the step S30, the information such as the following tone pitch ratio (FPR), the preceding tone pitch ratio (BPR), the following tone intensity ratio (FIR), the preceding tone intensity ratio (BIR), the following tone length ratio (FLR), and the preceding tone length ratio (BLR) calculated in the steps S33 to S35, and the information obtained in the step S36 constitute characteristic information on a tone of a note indicated by the pointer. Accordingly, the pattern of this characteristic information is compared with that of characteristic information on each partial waveform in a step S37 to select a partial waveform having the closest characteristic information. The ID of the selected partial waveform is stored in an SPWID register. This completes the partial waveform selecting process in the step S12.

Figure 12:
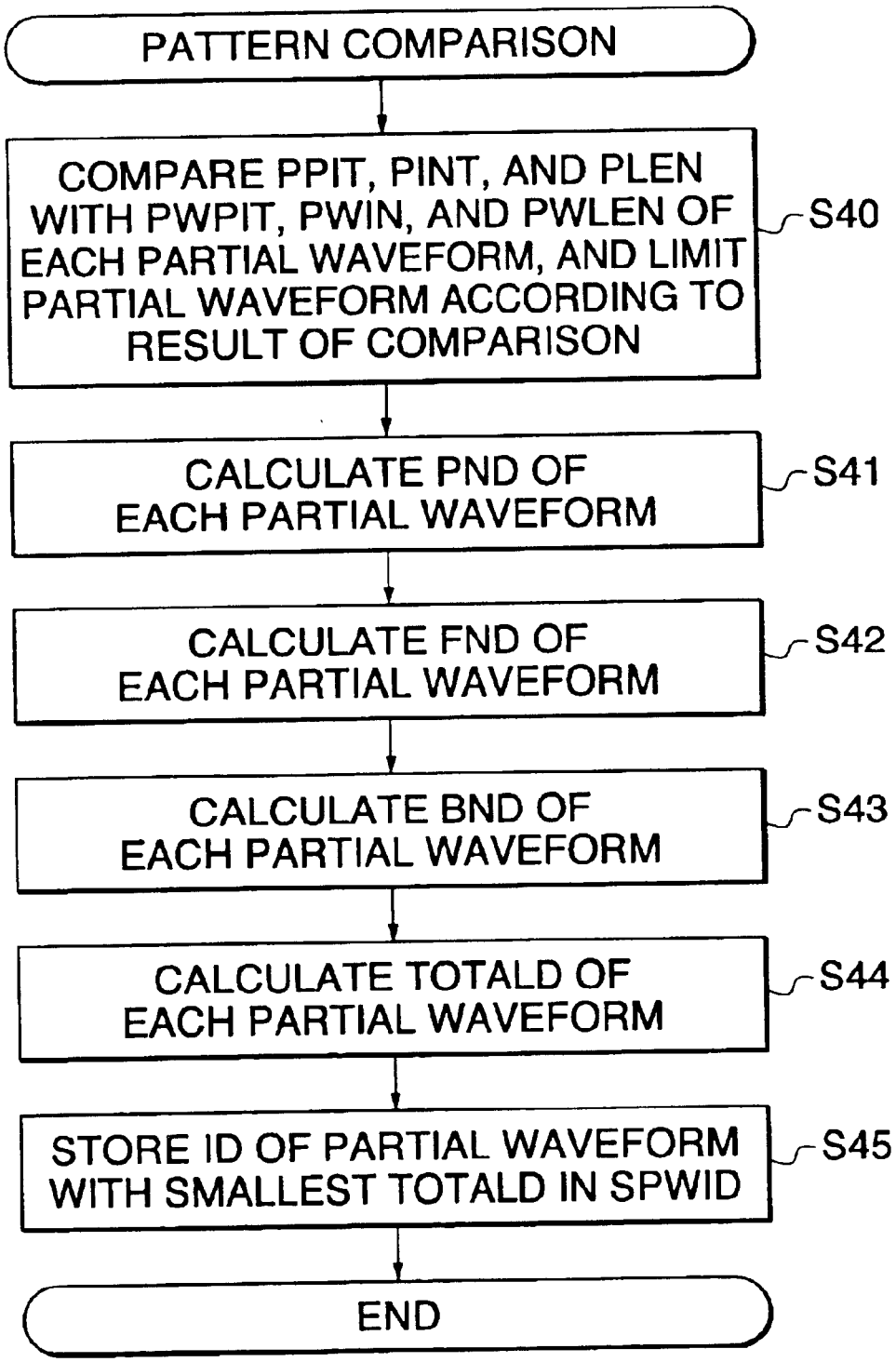
FIG. 12 is a flow chart showing a pattern comparing process in the flow chart of FIG. 11.

FIG. 12 is a flow chart showing the pattern comparing process carried out in the step S37.

In the pattern comparing process, the present tone pitch (PPIT), the present tone intensity (PINT), and the present tone length (PLEN) corresponding to the note indicated by the pointer are compared with a partial waveform tone pitch (PWPIT), a partial waveform tone intensity (PWINT), and a partial waveform tone length (PWLEN) of each partial waveform, to thereby select a limited number of candicate partial waveforms according to the result of the comparison, to reduce the number of calculations. An example of the method for selecting the candidate partial waveforms will now be given. First, partial waveforms with a difference between the partial waveform pitch (PWPIT) and the present tone pitch (PPIT) lying in a range $\Delta P$, a difference between the partial waveform tone intensity (PWINT) and the present tone intensity (PINT) lying in a range $\Delta I$, and a difference between the partial waveform tone length (PWLEN) and the present tone length (PLEN) lying in a range $\Delta L$ are selected. In this case, if the number of selected partial waveforms is too small, the ranges $\Delta P$, $\Delta I$, and $\Delta L$ are widened (the conditions are relaxed) to select partial waveforms again according to the widened ranges. If, however, the number of selected partial waveforms is sufficient, the limiting process is finished. Alternatively, the candidate partial waveforms may be selected as follows. First, distances (PND) representing differences between the present tone and respective ones of all partial waveforms are calculated in order to find the similarity between the present tone and the respective ones of partial waveforms in pitch, intensity, and tone length. Next, n partial waveforms are selected beginning from a partial waveform with the smallest distance representing the similarity.

After the candidate partial waveforms are selected in this manner, the distances relating to the pitch, intensity, and tone length of the respective ones of the selected partial waveforms and the tone of the note indicated by the pointer are calculated in a step S41 according to the following equation (7). If, however, the distances (PND) are calculated using the equation (7) in the step S40, the step S41 is skipped.

$$PND2=ap(PPIT-PWPIT)2+bp(PINT-PWINT)2+cp(PLEN-PWLEN)2 \quad (7)$$

In the equation (7), symbols ap, bp, and cp represent coefficients for PND calculation.

In a step S42, distances (FND) relating to the following tone pitch, following tone intensity, and following tone length ratio in respective ones of the selected candidate partial waveforms 1 and the pitch ratio, intensity ratio, and tone length ratio of the following tone to the present tone of the note indicated by the pointer are calculated according to the following equation (8):

$$FND2=af(FPR-PWFPR)2+bf(FIR-PWFIR)2+cf(FLR-PWFLR)2 \quad (8)$$

In the equation (8), symbols af, bf, and cf represent coefficients for FND calculation.

Further, in a step S43, distances (BND) relating to the preceding tone pitch, preceding tone intensity, and preceding tone length ratio in respective ones of the selected candidate partial waveforms and the pitch ratio, intensity ratio, and tone length ratio of the preceding tone to the present tone of the note indicated by the pointer are calculated according to the following equation (9):

$$BND2=af(BPR-PWBPR)2+bf(BIR-PWBIR)2+cf(BLR-PWBLR)2 \quad (9)$$

In the equation (9), symbols ab, bb, and cb represent coefficients for BND calculation.

In the next step S44, a total distance (TOTALD) representing the total similarity between respective ones of the selected candidate partial waveforms and the tone of the note indicated by the pointer is calculated according to the following equation (10) using the distances (PND), the distances (FND), and the distances (BND) calculated in the steps S41 to S43:

$$TOTALD=at\cdot PND+bt\cdot FND+ct\cdot BND \quad (10)$$

In the equation (10), symbols at, bt, and ct represnet coefficients for TOTALD calculation, and these coefficients have a relationship of at>ct>bt.

Upon calculation of the total distance (TOTALD) relating to the respective ones of the selected candidate partial waveforms in the step S44, a partial waveform with the smallest total distance (TOTALD) calculated in the step S45 is selected and an ID thereof is stored in the SPWID register. This completes the pattern comparing process.

It should be noted that in the step S12 of the performance data processing process, any one partial waveform is selected in whatever state of present data of a note indicated by the pointer in the performance data. However, the minimum conditions may be set for the degree of agreement or similarity between present data and property data, and then, if no property data of any of the partial waveforms satisfy the minimum conditions, it may be determined that "there is no corresponding partial waveform". If it is determined that there is no corresponding partial waveform, the user is preferably warned or an ordinary waveform memory tone generator preferably sounds tones instead of partial waveforms. Further, instead of selecting only one partial waveform, a second candidate partial waveform, a third candidate partial waveform, . . . may be automatically selected in advance according to an instruction from the user, and from among these candidate partial waveforms one partial waveform may be selected.

Referring next to a flow chart of FIG. 13, a description will be given of a note-on event process in the case where the tone color set is applied to real-time performance in the waveform data recording and reproducing apparatus 1 according to the present embodiment.

If a note-on event is generated by depressing the keyboard included in the operating element 15 or a note-on event is supplied via the MIDI interface 25, the present note-on event process is started to select the optimum partial waveform data by searching property information in the partial waveform management database for a designated tone color in the tone color set according to information such as pitch and intensity in the note-on event generated in the step S20. In this case, the selection of the partial waveform data may be based on combinations of information such as (1) the pitch of the note-on, (2) the pitch and intensity of the note-on, (3) the pitch of the note-on and information indicating whether the pitch of the preceding tone is higher or lower, (4) the pitch of the note-on and a difference in pitch between the preceding tone and the note-on, and (5) the intensity of the note-on and the preceding tone.

Upon selection of the optimum partial waveform corresponding to the note-on event, the reproducing circuit 24 assigns a sounding channel in a step S21, and in a step S22, information of the selected partial waveform data, tone color parameters, etc. are set to the assigned sounding channel. On this occasion, the pitch shift amount is also determined according to a difference in pitch between the note-on event and the selected partial waveform data. In the next step S23, the note-on is transmitted to the assigned sounding channel, and the reproducing circuit 24 reproduces a musical tone waveform according to the partial waveform data and tone color parameters and the pitch shift amount which have been thus set. The reproduction of the musical tone waveform corresponding to the note-on event completes the note-on event process, and if a note-on event based on real-time performance is generated again, the present note-on event process is started again to repeatedly carry out the process of reproducing a musical tone waveform corresponding to the note-on event.

It should be noted that in real-time performance, the length of a tone to be generated by performance is not known until the a corresponding note-off occurs, and it is therefore impossible to carry out time-base control of the partial waveform data according to the tone length. Accordingly, as is the case with conventional ordinary waveform memory tone generators, a constant section of the musical tone waveform immediately following an attack thereof is provided with a loop section for performing loop reproduction so that the length of the musical tone is controlled by providing an attenuation envelop according to loop reproduction+ note-off.

Further, in a variation in the case where the tone color set is applied to real-time performance, if a delay of several seconds to several dozens of seconds in sounding is allowed from the generation of the note-on to the sounding, a performance event occurring during the delay time period is stored in a buffer so that information such as the tone length of the note-on and the preceding tone can also be used in selection of partial waveform data.

Figure 13:
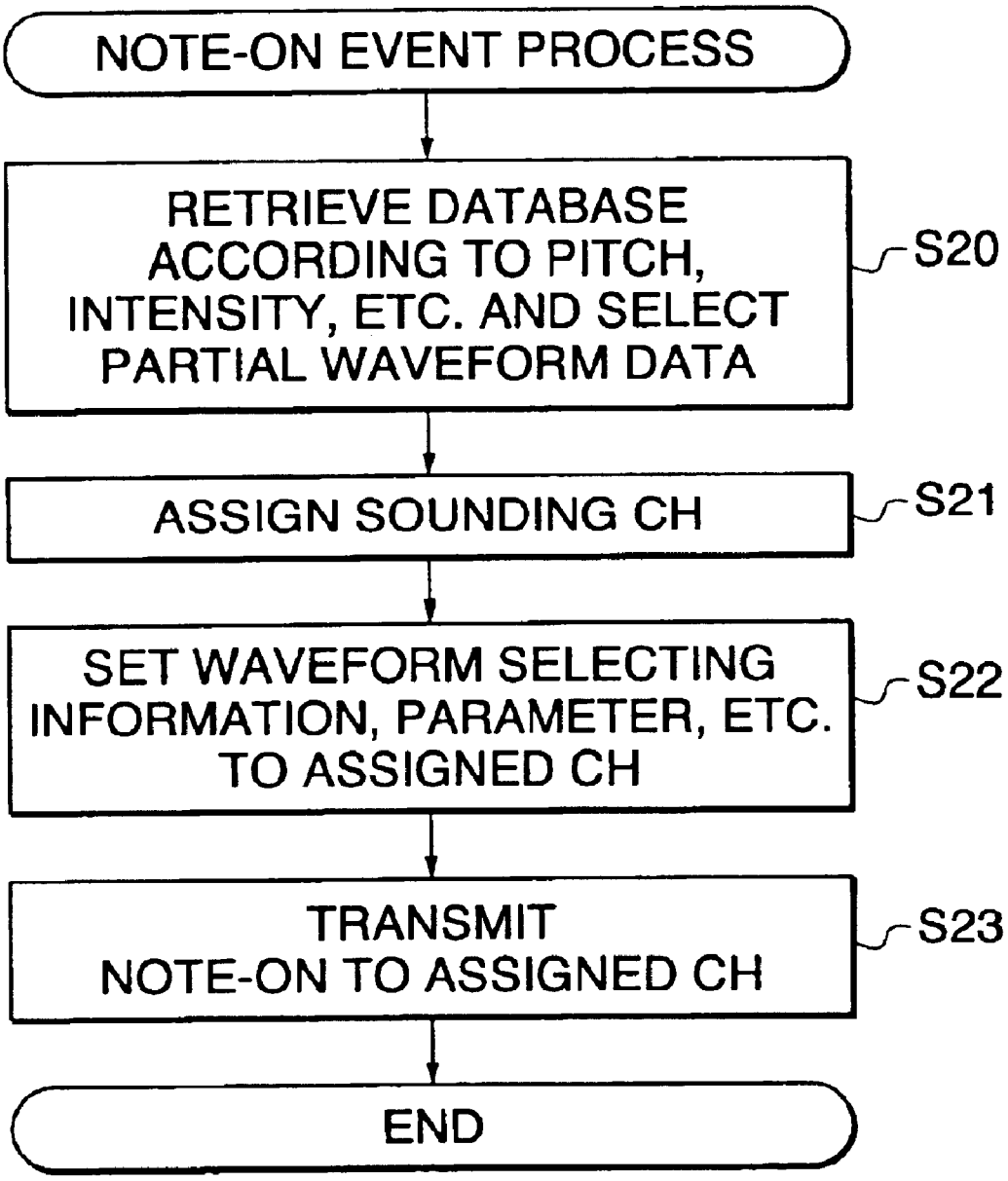
FIG. 13 is a flow chart showing a note-on event process carried out by the waveform data recording and reproducing apparatus according to the embodiment.
Figure 14:
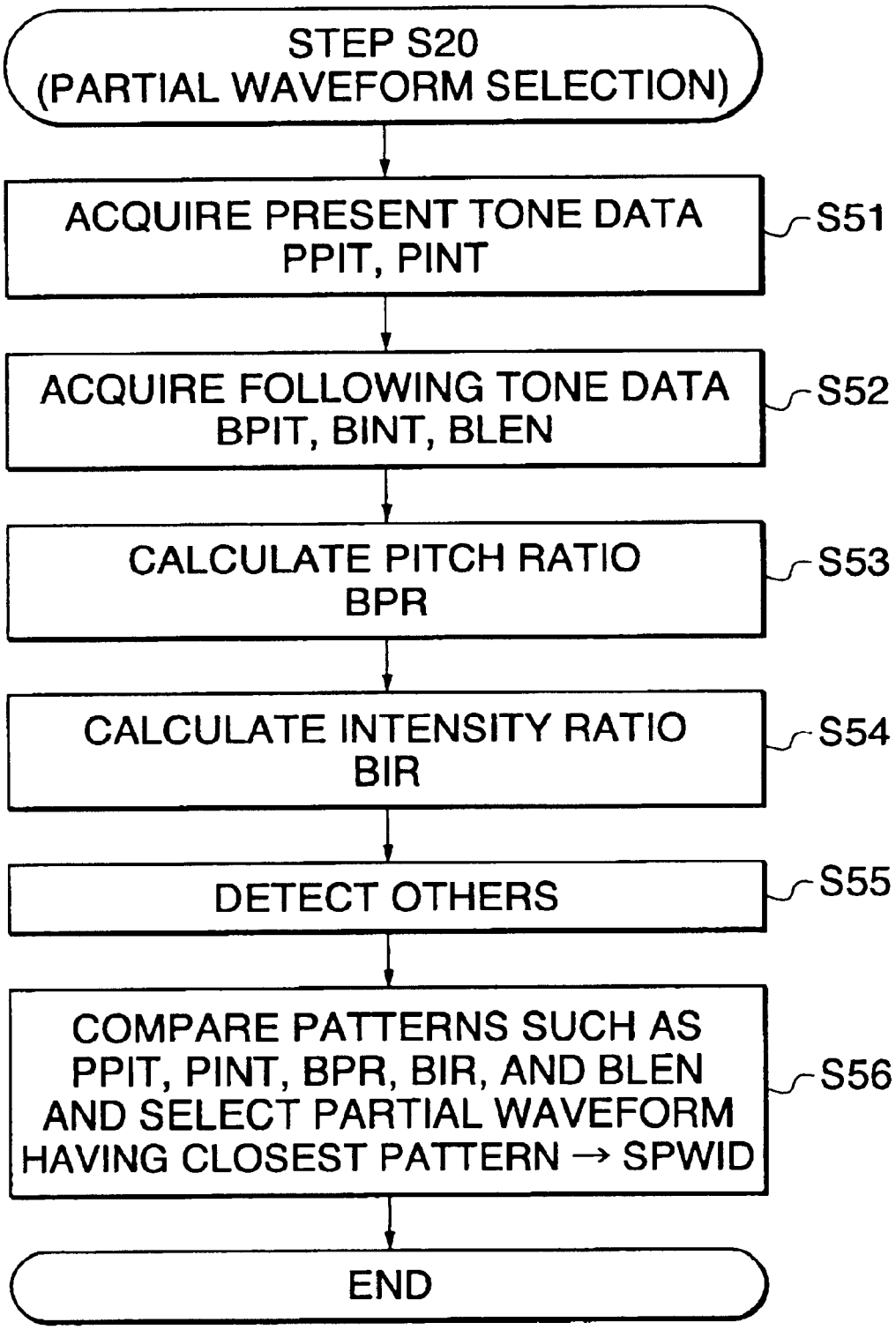
FIG. 14 is a process in a step S20 in the note-on event process of FIG. 13.

FIG. 14 is a flow chart showing the partial waveform selecting process carried out in the step S20 of the note-on event process in FIG. 13.

In the partial waveform selecting process in the step S20, the present tone pitch (PPIT) and the present tone intensity (PINT) of a noted-on present tone are acquired in a step S51. However, the present tone length (PLEN) cannot be acquired since the tone is being noted-on. Next, preceding tone data such as the preceding tone pitch (BPIT), preceding tone intensity (BINT), and preceding tone length (BLEN) of the preceding tone in the previous note-on are acquired in a step S52. In the next step S53, a pitch ratio (BPR) of the acquired present tone pitch (PPIT) to the preceding tone pitch (BPIT) is calculated according to the above-mentioned equation (2). Further, in a step S54, an intensity ratio (BIR) of the present tone intensity (PINT) to the preceding tone intensity (BINT) is calculated according to the above-mentioned equation (4). Further, in a step S55, the detection of other parameters is carried out, that is, the extent of slur is detected and the vibration width of the pitch bend data is detected as the depth of vibrato according to a period of time in which the present tone overlaps the preceding tone, the variation of the intensity, and the like.

The pattern of the characteristic data of the noted-on present tone pitch (PPIT) and present tone intensity (PINT), the calculated preceding tone pitch ratio (BPR) and preceding tone intensity ratio (BIR) obtained in the steps S51 to S55 are compared with that of the characteristic data of each partial waveform to select a partial waveform with the closest characteristic data. The ID of the selected partial waveform is stored in the SPWID register. This completes the partial waveform selecting process in the step S20. It should be noted that the pattern comparing process can be carried out in the same manner as the pattern comparing process in FIG. 12. However, since there is no following tone, the patterns are compared based on data relating to the present tone and the preceding tone. More specifically, the distance (FND) relating to the following tone is not calculated, and the distance (PND) relating to the present tone is calculated using the coefficient ap set to zero. According to the calculated distance (PND) and distance (BND), the total distance (TOTALD) is calculated to select a partial waveform with the smallest total distance (TOTALD), and the ID of the selected partial waveform is stored in the SPWID register.

Incidentally, the tone color set may be applied to a combination of automatic performance and real-time performance in the waveform data recording and reproducing apparatus 1 according to the present embodiment. In this case, musical tone waveforms based on performance data processed by the performance data processing process in FIG. 10 are generated in the automatic performance, and musical tone waveforms are generated by carrying out the note-on event process in FIG. 13 in the real-time performance in which the player makes performance according to the automatic performance. In this combination, if the real time performance is made in accordance with the automatic performance such as automatic rhythms, automatic accompaniment, and accompaniment parts, a tempo clock can be obtained from the automatic performance. Accordingly, if performance data for a real-time performance part performed by the player is prepared, he or she makes performance according to the real-time performance part, and this enables detection of conditions of following events such as note-on events and note-off events in the real-time performance. Therefore, in the partial waveform selecting process in the step S20 of the note-on event process in FIG. 13, a partial waveform can be selected using information on the tone length of a present note-on and information on a tone to be generated by performance next, as well. Incidentally, in the case where automatic performance is made according to performance data composed of sixteen parts, if the first part is a real-time performance part, the automatic performance generates musical tones for the second to sixteenth parts. On the other hand, the first part is used for the selection of a partial waveform described above.

As mentioned above, in the case of automatic performance, a tempo clock can be obtained from the automatic performance. More specifically, only in automatic performance, a tempo timer generates a tempo interrupt at time intervals corresponding to the tempo. A tempo counter counts up by a predetermined value at every tempo interrupt. A present counter value POS of the tempo counter indicates an advancement position of automatic performance in performance data. This position does not indicate an address position on a memory storing performance data, but indicates a position based on a tempo clock representing which clock of which beat in which measure. The performance data includes a real-time performance part performed by the player, and the present position of the real-time performance part is also determined in synchronism with automatic performance of other parts.

Figure 15:
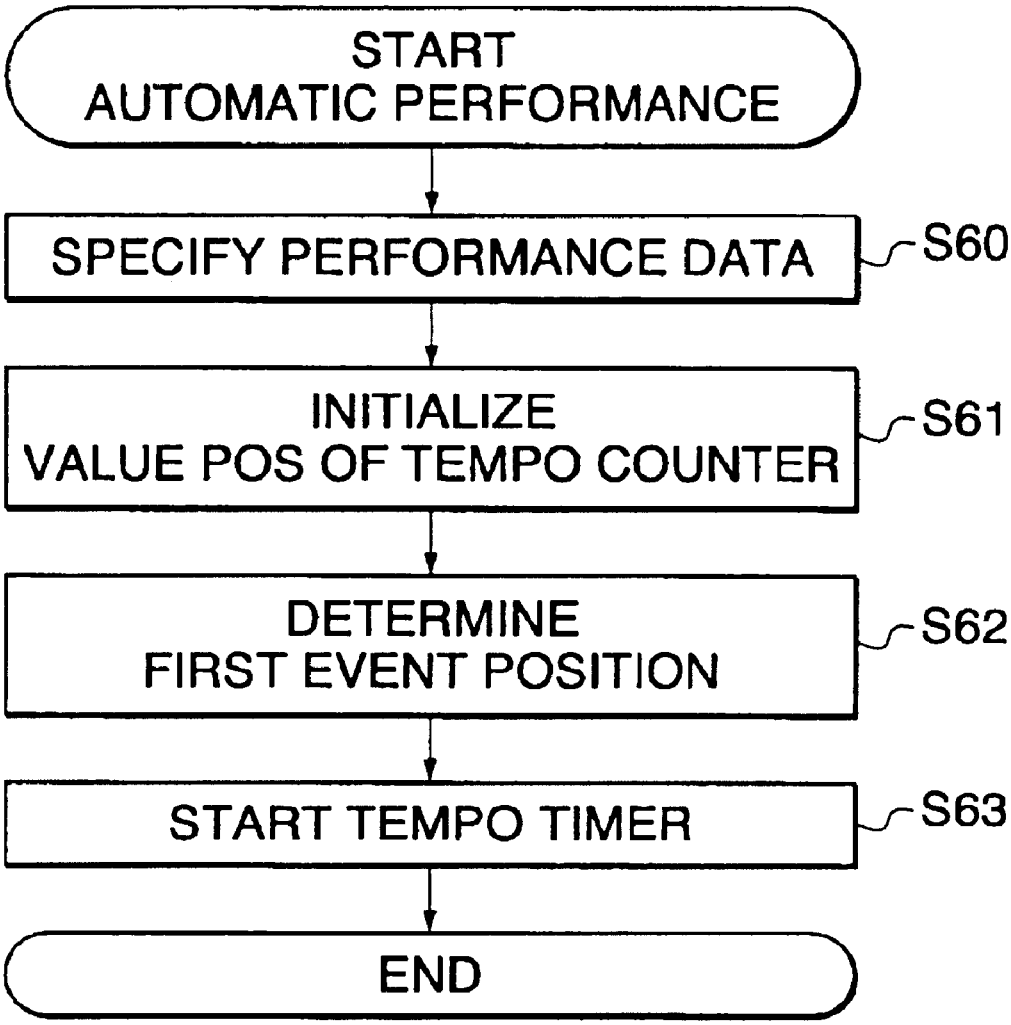
FIG. 15 is a flow chart showing an automatic performance starting process carried out by the waveform data recording and reproducing apparatus according to the embodiment.

FIG. 15 is a flow chart showing an automatic performance starting process in which the tempo counter is initialized.

Upon start of the automatic performance starting process, performance data for automatic performance is specified in a step S60. The value POS of the tempo counter is then initialized in a step S61. A first event position in the specified performance data is then determined in a step S62, and the tempo timer is started in a step S63. This starts automatic performance to cause the tempo timer to be incremented, and when the determined event position is reached, a corresponding event is reproduced.

Figure 16:
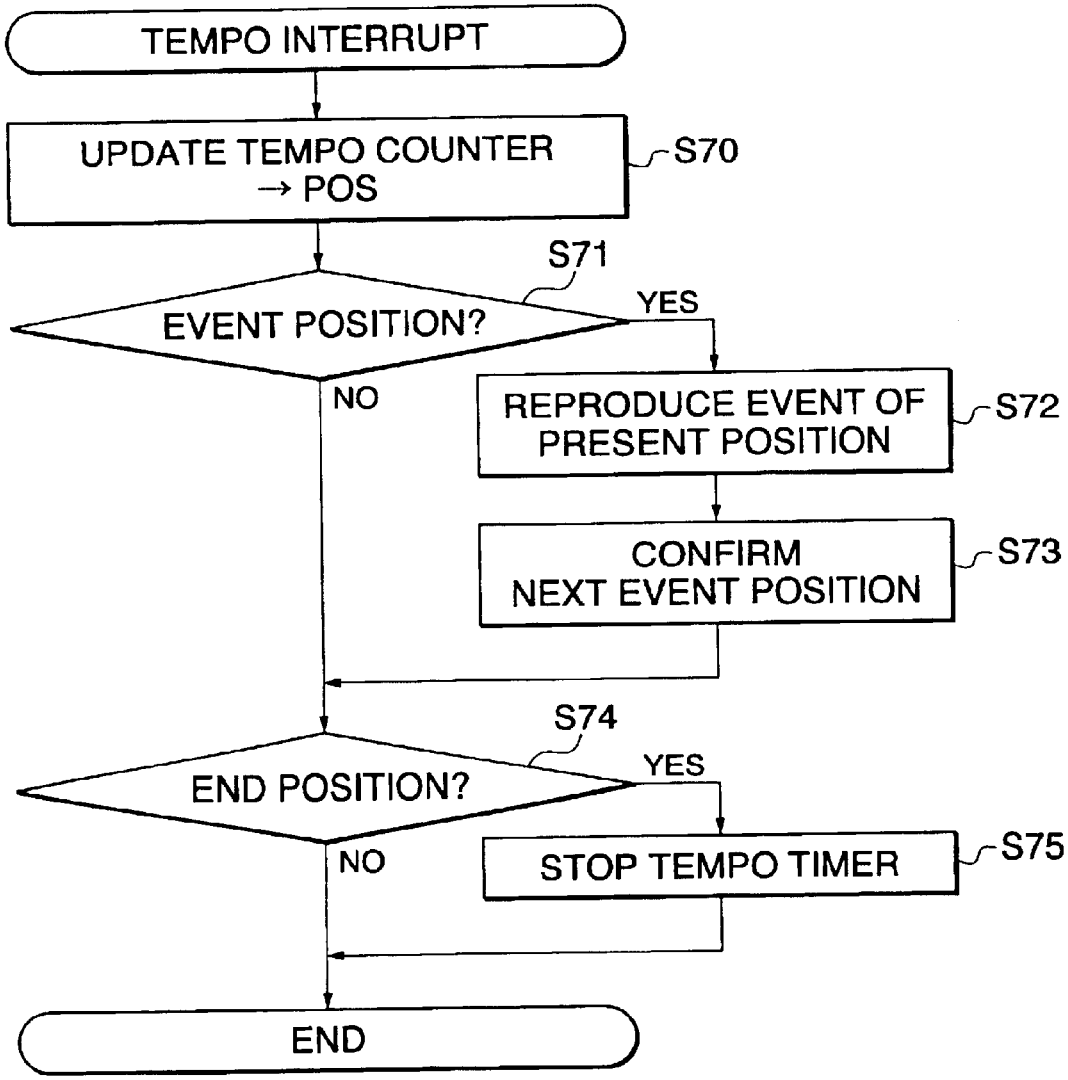
FIG. 16 is a flow chart showing a tempo interrupting process carried out by the waveform data recording and reproducing apparatus according to the embodiment during automatic performance.

FIG. 16 is a flow chart showing a tempo interrupting process for updating the tempo counter.

If a tempo interrupt occurs, the tempo interrupting process is started to cause the value POS indicated by the tempo counter to increase by a predetermined value at every tempo interrupt in a step S70. It is then determined in a step S71 whether the present time point corresponds to an event position or not. If it is determined that the present time point corresponds to an event position, the process proceeds to a step S72 wherein an event at the event position is reproduced, and upon completion of the reproduction, a next event position is determined in a step S72, and the process proceeds to a step S74. In this case, if the event is an event in real-time performance, the event is not reproduced. If it is determined in the step S71 that the present time point does not correspond to an event position, the process proceeds directly to the step S74 wherein it is determined whether the present time point corresponds to an end position or not. If it is determined that the present time point corresponds to the end position, the process proceeds to a step S75 wherein the tempo timer is stopped to terminate the tempo interrupting process. On this occasion, the automatic performance is terminated. If it is determined in the step S74 that the present time point does not correspond to the end position, the tempo interrupting process is terminated.

Figure 17:
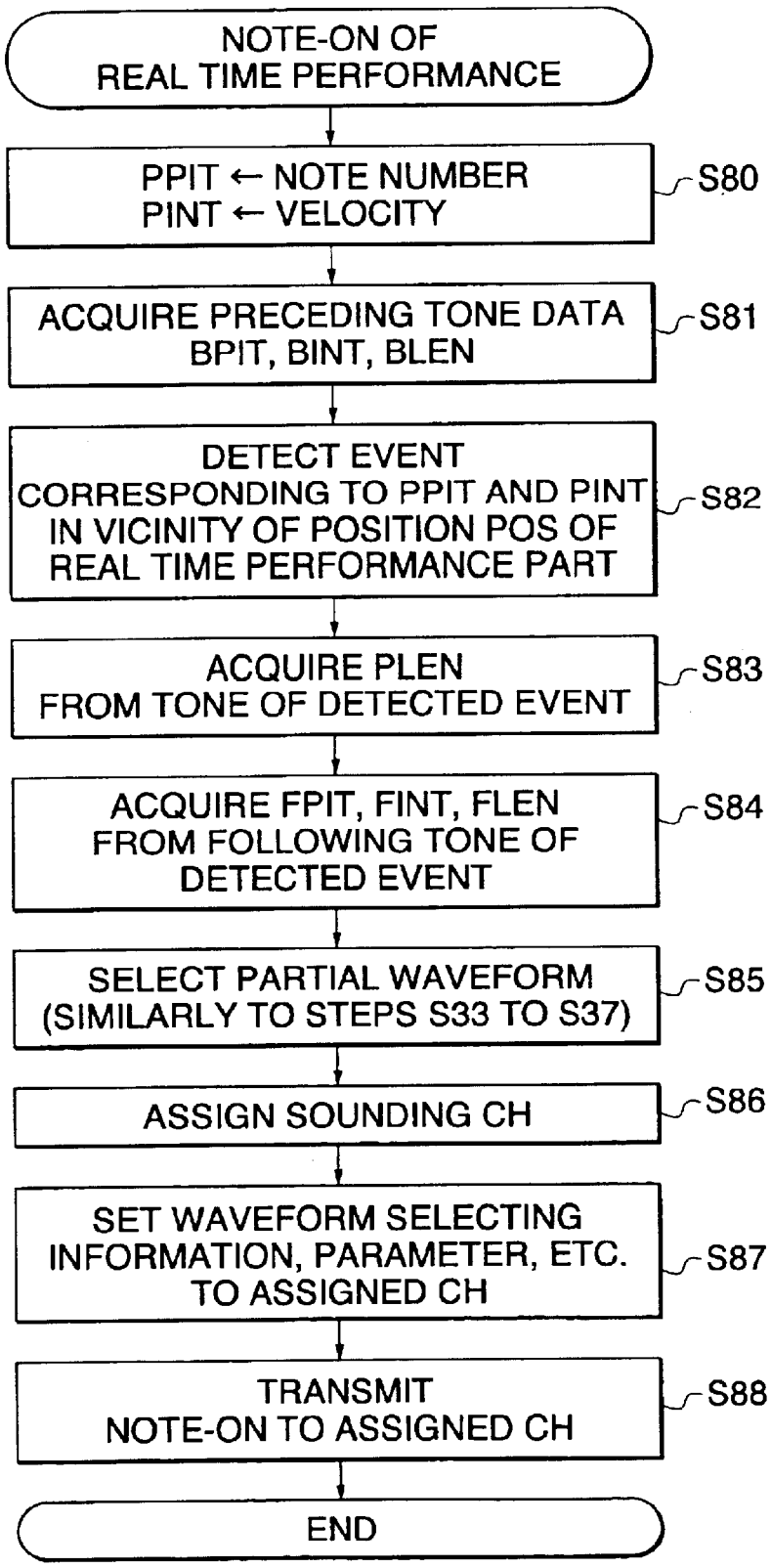
FIG. 17 is a flow chart showing a note-on process carried out by the waveform data recording and reproducing apparatus according to the embodiment during real-time performance made in combination with automatic performance.

FIG. 17 is a flow chart showing a note-on process for the real-time performance made in combination with the automatic performance.

When a note-on of the real-time performance is detected, the present note-on process for the real-time performance is started to store a note number of the detected note-on in a PPIT register and store the velocity in a PINT register in a step S80. Then, preceding tone data of preceding tone pitch (BPIT), preceding tone intensity (BINT), and preceding tone length (BLEN) are acquired from the real-time performance in a step S81. Further, in a range in proximity to the value POS of the tempo counter indicating the present performance position, a note-on event for a real-time performance part in the performance data corresponding to the detected note-number (PPIT) and velocity (PINT) is detected in a step S82. Data of note-on tone length (PLEN) is acquired based on the tone of the detected event in a step S83. In this case, a note-off event corresponding to the event (note-on event) is detected from the performance data for the real-time performance part to obtain tone length information.

Then, following tone data of following tone pitch (FPIT), following tone intensity (FINT), and following tone length (FLEN) is acquired based on the following tone in the performance data of the detected event. In the next step S85, a partial waveform selecting process is carried out based on the data acquired from the performance data according to the acquired note-on data and the data acquired from the performance data based on the note-on data. In this partial waveform selecting process, the process from the steps S33 to S37 of the partial waveform selecting process in FIG. 11 is carried out. This selects a partial waveform with characteristic data closest to characteristic data of the note-on tone. Upon selection of the optimum partial waveform corresponding to the note-on tone, the reproducing circuit 24 assigns a sounding channel in a step S86, and information on the selected partial waveform, tone color parameters, and the like are set to the assigned sounding channel in a step S87. In this case, the pitch shift amount is also set based on the difference in pitch between the note number (PPIT) of the detected note-on and the selected partial waveform.

The note-on is then transmitted to the assigned sounding channel in a step S88, and the reproducing circuit 24 reproduces a musical tone waveform based on the set partial waveform, tone color parameters, and pitch shift amount. Upon reproduction of the musical tone waveform corresponding to the note-on, the note-on process for the real-time performance is terminated. If a note-on of real-time performance is generated again, the note-on process is started again to repeatedly carry out the above-described process of regenerating a musical tone waveform corresponding to the note-on event.

Although in the note-on process for real-time performance in FIG. 17, the tone pitch (PPIT), intensity (PINT), preceding tone pitch (BPIT), preceding tone intensity (BINT), and preceding tone length (BLEN) are acquired from the real-time performance, data obtained from performance data for a real-time performance part may be used for partial waveform selection. By using such data, a partial waveform to be selected upon each note-on in real-time performance can be selected in advance prior to the real-time performance. However, for the control of parameters for sounding, the real-time performance data is directly used.

It should be noted that if all notes of pitch required for multiple sampling in which the keyboard range is divided into predetermined ranges and sampling waveforms are assigned to the predetermined ranges are included in phrases of performance data, all partial waveform data of the required pitch can be recorded as part of the recorded data. By doing so, performance can be made based on partial waveform data obtained by the multiple sampling immediately after the performance of the phrases is completed. On this occasion, all the notes of required tone length and performance intensity may be included in the phrases of the performance data.

Further, it may be arranged such that all partial waveform data obtained by dividing phrase waveform data can be used as tone color sets. Then, the procedure for creating selected tone color sets can be omitted, enabling performance to be immediately started.

Further, various kinds of information may be used for other purposes than their original purposes. For example, in the case where a singing voice is sampled, "intensity information" may be used as "phoneme information" for discriminating the phoneme of the sound. Specifically, the intensity=60 is assigned as information representing a phoneme "ah-ah-ah-", the intensity=61 is assigned as information representing "ra-ra-ra-", and the intensity=62 is assigned as information representing a phoneme "du-du-du-". If the "intensity information" is used as the "phoneme information" as mentioned above, by grouping partial waveform data according to the "intensity information", groups of partial waveform data corresponding to respective identical phonemes can be collected.

Further, performance data to be processed by the performance data processing process may be used directly as corresponding performance data serving as performance data for use in recording. This enables partial waveform data acquired by the division to be attached to the performance data after the recorded waveform data is divided into the partial waveform data, which simplifies the optimum partial waveform data detecting process.

Further, by editing respective notes of the performance data to which is attached the partial waveform data, the recorded phrase waveform data can be edited indirectly.

Further, the performance data processing method according to the present invention enables the optimum partial waveform data for characteristics of each note in the performance data to be selected in advance and assigned to each note in the performance data. The use of such performance data eliminates the necessity of selecting the optimum partial waveform data during waveform generation.

What is claimed is:

1. A waveform generating method comprising the steps of:

storing a plurality of partial waveforms in a partial waveform memory;

storing property information on respective ones of the partial waveforms stored in the partial waveform memory, in a property information memory, the property information being indicative of at least one characteristic of performance relating to a corresponding one of the partial waveforms that is included in a phrase, the characteristic being obtained by actual performance of the phrase;

detecting a partial waveform having property information corresponding to inputted sounding control information by referring to the property information memory according to the inputted sounding control information, and reading out the detected partial waveform from the partial waveform memory;

processing the readout partial waveform according to the property information and the sounding control information; and generating a waveform corresponding to the sounding control information.

2. A waveform generating method according to claim 1, wherein the property information comprises pitch, intensity, length, and pitch ratio between a present tone corresponding to a partial waveform and a following tone.

3. A waveform generating method according to claim 1, wherein the sounding control information comprises property of a present tone corresponding to a partial waveform and a preceding tone, and wherein said detecting step comprises detecting a partial waveform that has property information corresponding to the property of the preceding tone and the present tone.

4. A waveform generating method according to claim 3, wherein the pitch ratio is calculated according to a predetermined expression based on the pitch of the preceding tone and the pitch of the present tone.

5. A waveform generating method according to claim 3, wherein the intensity ratio is calculated according to a predetermined expression based on the intensity of the preceding tone and the intensity of the present tone.

6. A waveform generating method according to claim 1, wherein the sounding control information comprises:

pitch, intensity, and length of a present tone corresponding to a partial waveform;

pitch, intensity, and length of a preceding tone; and pitch ratio and intensity ratio between the present tone and the preceding tone.

7. A performance data processing method comprising the steps of:

storing property information on respective ones of a plurality of partial waveforms in a property information memory, the property information being indicative of at least one characteristic of performance relating to a corresponding one of the partial waveforms that is included in a phrase, the characteristic being obtained by actual performance of the phrase;

comparing characteristics of respective ones of notes included in performance data with the property information stored in the property information memory to detect an optimum partial waveform for a characteristic of each of the notes;

assigning designation data for designating the detected partial waveform to each of the notes; and storing performance data having the designation data assigned thereto.

8. A waveform generating method for use in reproducing the performance data having the designation data assigned thereto stored by a performance data processing method according to claim 7, comprising the steps of:

storing a plurality of partial waveform in a partial waveform memory;

reading out a partial waveform from the partial waveform memory according to the designated data assigned to each of the notes to be reproduced when reproducing the notes having the designation data assigned thereto according to the performance data; and generating a waveform corresponding to each of the notes based upon the read out partial waveform.

9. A performance data processing method according to claim 7, wherein the property information comprises pitch, intensity, length, and pitch ratio between a present tone corresponding to a partial waveform and a following tone.

10. A performance data processing method according to claim 7, wherein the designation data comprises of a meta event and a system exclusive message.

11. A performance data processing method according to claim 7, wherein the designation data is inserted prior to the event data of the performance data.

12. A waveform generating method comprising the steps of:

storing performance information corresponding to real-time performance;

generating accompanying tones by automatic performance or automatic accompaniment according to a tempo clock;

inputting performance events in real time while the accompanying tones are generated;

detecting a performance event that follows one of the inputted performance events based on the stored performance information according to the tempo clock; and generating waveforms according to the inputted performance events and the detected performance event.

13. A waveform selection apparatus comprising:

a partial waveform memory that stores a plurality of partial waveforms;

a database that stores property data representing characteristics of a present tone corresponding to each of the partial waveforms stored in said partial waveform memory and a preceding tone that precedes the present tone in a phrase that includes the partial waveform; and a retrieving device that retrieves the property data from said database according to characteristic data of a present tone designated by inputted present performance and a preceding tone designated by preceding performance inputted before the present performance to extract at least one partial waveform corresponding to property data close to the characteristic of the two tones designated by the present performance and the preceding performance to generate a waveform corresponding to the present tone based on the extracted at least one partial waveform.

14. A waveform selection apparatus comprising:

a partial waveform memory that stores a plurality of partial waveforms;

a database that stores property data representing characteristics of a present tone corresponding to each of the partial waveforms stored in said partial waveform memory and a following tone that follows the present tone in a phrase that includes the partial waveform; and a retrieving device that retrieves the property data from said database according to characteristic data of a present tone designated by inputted present performance and a following tone designated by following performance inputted after the present performance to extract at least one partial waveform corresponding to property data close to the characteristic of the two tones designated by the present performance and the following performance to generate a waveform corresponding to the present tone based on the extracted at least one partial waveform.

15. A waveform data recording apparatus comprising:

an automatic performing device that reproduces tones based on performance data comprising a plurality of notes relating to a phrase to be recorded, wherein a player hears the reproduced tones and sounds a phrase along with the reproduced tones;

a waveform recording device that records a phrase waveform sounded by the player; and a waveform data processing device that divides the phrase waveform into partial waveform data according to a characteristic of each of the notes in performance data.

16. A waveform data recording apparatus according to claim 15, wherein said waveform recording device records the phrase waveforms in synchronism with performance timing of said automatic performing device.

17. A waveform data recording apparatus according to claim 15, wherein said waveform data processing device assigns the characteristic of each of the notes corresponding to the partial waveform data as property information to the partial waveform data.

18. A waveform data recording apparatus according to claim 17, comprising a device that creates a tone color set from a partial waveform pool in which selected partial waveform data selected from the partial waveform data is pooled, and a partial waveform management database composed of the property information assigned to respective ones of the selected partial waveform data pooled in the partial waveform pool.

19. A recorded waveform data reproducing apparatus comprising:

a storage device that stores a tone color set from a partial waveform pool in which selected partial waveform data selected from the partial waveform data is pooled, and a partial waveform management database composed of property information assigned to respective ones of the selected partial waveform data pooled in the partial waveform pool;

a detecting device that retrieves data from the partial waveform management database in the tone color set by characteristic information on respective notes in performance data to detect optimum partial waveform data for each of the notes from the partial waveform pool;

a designation data inserting device that embeds designation data for designating the optimum partial waveform data detected by said detecting device to each of the notes into the performance data; and a reproducing device that automatically reproduces the performance data in which the designation data is embedded by said designation data inserting device, according to the optimum partial waveform data designated by the designation data.

20. A recorded waveform data reproducing apparatus according to claim 19, wherein the designation data comprises of a meta event and a system exclusive message.

21. A recorded waveform data reproducing apparatus according to claim 19, wherein the designation data is inserted prior to the event data of the performance data.

22. A recorded waveform data reproducing apparatus comprising:

a storage device that stores a tone color set from a partial waveform pool in which selected partial waveform data selected from the partial waveform data is pooled, and a partial waveform management database composed of property information assigned to respective ones of the selected partial waveform data pooled in the partial waveform pool;

a detecting device that retrieves data from the partial waveform management database in the tone color set by information on respective performance event data that have occurred, to detect optimum partial waveform data for each of the performance event data from the partial waveform pool; and a reproducing device that reproduces the performance event data according to the optimum partial waveform data detected by said detecting device.

23. A recorded waveform data reproducing apparatus comprising:

a storage device that stores a tone color set from a partial waveform pool in which selected partial waveform data selected from the partial waveform data is pooled, and a partial waveform management database composed of property information assigned to respective ones of the selected partial waveform data pooled in the partial waveform pool;

a detecting device that retrieves data from the partial waveform management database in the tone color set by characteristic information on respective notes in performance data read in advance to detect optimum partial waveform data for each of the notes from the partial waveform pool; and a reproducing device that is responsive to occurrence of performance event data corresponding to respective ones of the notes in the performance data, for reproducing performance tones corresponding to the respective ones of the notes according to the optimum partial waveform data detected by said detecting device.

* * * * *